US008994756B2

(12) United States Patent
Kimura et al.

(10) Patent No.: US 8,994,756 B2
(45) Date of Patent: Mar. 31, 2015

(54) METHOD FOR DRIVING DISPLAY DEVICE IN WHICH ANALOG SIGNAL AND DIGITAL SIGNAL ARE SUPPLIED TO SOURCE DRIVER

(75) Inventors: Hajime Kimura, Kanagawa (JP); Shunpei Yamazaki, Tokyo (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 875 days.

(21) Appl. No.: 11/381,073

(22) Filed: May 1, 2006

(65) Prior Publication Data

US 2008/0084403 A1 Apr. 10, 2008

(30) Foreign Application Priority Data

May 2, 2005 (JP) ..... 10-2005-133825

(51) Int. Cl.
*G09G 5/10* (2006.01)
*G09G 3/30* (2006.01)
(Continued)

(52) U.S. Cl.
CPC ..... *G09G 3/3241* (2013.01); *G09G 3/2011* (2013.01); *G09G 3/325* (2013.01); *G09G 3/3291* (2013.01); *G09G 2300/0439* (2013.01); *G09G 2300/0819* (2013.01);
(Continued)

(58) Field of Classification Search
CPC ..... G09G 3/30–3/3291; G09G 3/36–3/3696; G09G 2300/0439–2300/0495; G09G 2310/027–2310/0272
USPC ..... 345/76–83, 84–104, 204–215, 345/690–699; 315/169.1–169.4
See application file for complete search history.

(56) References Cited

U.S. PATENT DOCUMENTS 3,838,209 A * 9/1974 Tsuchiya et al. ..... 348/800
4,386,345 A 5/1983 Narveson et al.
5,168,270 A * 12/1992 Masumori et al. ..... 345/100
(Continued)

FOREIGN PATENT DOCUMENTS

CN 1290388 A 4/2001
CN 1323025 A 11/2001
(Continued)

OTHER PUBLICATIONS

Hajime Washio et al.; "TFT-LCDs with Monolithic Multi-Drivers for High Performance Video and Low-Power Text Modes"; *SID Digest '01 :SID International Symposium Digest of Technical Papers*; pp. 276-279; Jan. 1, 2001.
(Continued)

*Primary Examiner* — Patrick F Marinelli
(74) *Attorney, Agent, or Firm* — Fish & Richardson P.C.

(57) ABSTRACT

A display method and device obtains advantages of both an analog gray scale method and a digital gray scale method by performing display in multiple display modes. In a display mode-specific video signal generation circuit, an input video signal is output, as an analog value without any change, as a binary digital value, and as a multi-valued digital value. As a result, the display mode changes in a timely manner. Accordingly, a clear image can be displayed. In other words, an analog signal and a digital signal are switched and input to a source driver. In addition, the display device also switches and outputs an analog signal and a digital signal such that the display device can have the advantages of both the analog gray scale method and the digital gray scale method.

15 Claims, 30 Drawing Sheets

(51) Int. Cl.
*G09G 3/32* (2006.01)
*G09G 3/20* (2006.01)

(52) U.S. Cl.
CPC ..... *G09G 2300/0842* (2013.01); *G09G 2300/0861* (2013.01); *G09G 2310/027* (2013.01)
USPC ..... 345/690; 345/76; 345/83

(56) References Cited

U.S. PATENT DOCUMENTS 5,333,243 A 7/1994 Best et al.
5,363,118 A * 11/1994 Okumura ..... 345/95
5,367,314 A * 11/1994 Okada et al. ..... 345/98
5,406,305 A 4/1995 Shimomura et al.
5,489,918 A 2/1996 Mosier
5,523,772 A * 6/1996 Lee ..... 345/98
5,585,856 A 12/1996 Nakaya et al.
5,612,732 A * 3/1997 Yuyama et al. ..... 348/14.01
5,705,424 A 1/1998 Zavracky et al.
5,818,419 A 10/1998 Tajima et al.
5,867,140 A 2/1999 Rader
5,933,130 A 8/1999 Wagner
6,037,917 A 3/2000 Kawakami
6,040,812 A 3/2000 Lewis
6,088,012 A 7/2000 Shigeta et al.
6,201,535 B1 3/2001 Hwang
6,229,505 B1 5/2001 Fujii
6,339,422 B1 1/2002 Kuwajima et al.
6,396,508 B1 5/2002 Noecker
6,414,661 B1 * 7/2002 Shen et al. ..... 345/82
6,417,824 B1 7/2002 Tokunaga et al.
6,462,726 B1 10/2002 Hamada et al.
6,501,227 B1 * 12/2002 Koyama ..... 315/169.3
6,504,522 B2 * 1/2003 Shiraki et al. ..... 345/98
6,512,504 B1 * 1/2003 Yamauchi et al. ..... 345/87
6,552,736 B2 4/2003 Honda et al.
6,593,920 B2 7/2003 Okumura et al.
6,593,939 B2 7/2003 Yamada et al.
6,628,258 B1 * 9/2003 Nakamura ..... 345/98
6,646,625 B1 11/2003 Shigeta et al.
6,671,023 B2 12/2003 Tsutsui et al.
6,678,834 B1 1/2004 Aihara et al.
6,693,614 B2 2/2004 Kamiya et al.
6,727,880 B2 4/2004 Lee
6,738,036 B2 5/2004 Janssen et al.
6,753,918 B1 6/2004 Kanayama
6,784,898 B2 * 8/2004 Lee et al. ..... 345/692
6,803,886 B2 10/2004 Kondo et al.
6,806,859 B1 10/2004 Kanoh et al.
6,831,621 B2 12/2004 Nakano
6,853,371 B2 2/2005 Miyajima et al.
6,865,404 B1 * 3/2005 Tikkala et al. ..... 455/566
6,937,214 B2 * 8/2005 Chen et al. ..... 345/76
6,943,766 B2 * 9/2005 Nakamura et al. ..... 345/98
6,970,121 B1 11/2005 Sun
7,012,599 B2 3/2006 Sun
7,019,738 B2 3/2006 Tsutsui
7,081,875 B2 * 7/2006 Yokoyama et al. ..... 345/90
7,123,248 B1 * 10/2006 Lafleur ..... 345/204
7,145,530 B2 12/2006 Miyazawa
7,190,338 B2 3/2007 Kubota
7,249,816 B2 7/2007 Kusunoki et al.
7,283,109 B2 10/2007 Koyama
7,286,105 B2 10/2007 Akimoto et al.
7,289,092 B2 10/2007 Shimizu et al.
7,327,428 B2 2/2008 Yamazaki et al.
7,339,570 B2 3/2008 Kubota
7,487,273 B2 2/2009 Kobayashi
7,502,039 B2 3/2009 Koyama et al.
7,515,126 B2 4/2009 Senda et al.
7,525,520 B2 * 4/2009 Miyazawa ..... 345/76
7,589,699 B2 9/2009 Miyazawa
7,636,078 B2 12/2009 Yamazaki et al.
7,808,495 B2 10/2010 Tsutsui
8,125,414 B2 2/2012 Hunter et al.
2001/0005193 A1 6/2001 Yokoyama
2001/0005196 A1 6/2001 Ishii
2001/0011989 A1 8/2001 Hayashi
2001/0022565 A1 9/2001 Kimura
2001/0033252 A1 10/2001 Yamazaki et al.
2002/0000969 A1 1/2002 Ozawa
2002/0011978 A1 1/2002 Yamazaki et al.
2002/0015043 A1 2/2002 Matsuda
2002/0024529 A1 2/2002 Miller et al.
2002/0047568 A1 4/2002 Koyama
2002/0047852 A1 4/2002 Inukai et al.
2002/0056838 A1 5/2002 Ogawa
2002/0075249 A1 * 6/2002 Kubota et al. ..... 345/204
2002/0109659 A1 8/2002 Hiroki
2002/0113761 A1 * 8/2002 Mizutani et al. ..... 345/87
2002/0132454 A1 9/2002 Ohtsu et al.
2002/0154151 A1 10/2002 Koyama
2002/0158857 A1 * 10/2002 Iisaka ..... 345/204
2002/0163591 A1 11/2002 Tsutsui
2002/0171607 A1 11/2002 Senda et al.
2003/0025663 A1 * 2/2003 Waterman et al. ..... 345/89
2003/0058235 A1 3/2003 Moon
2003/0063077 A1 * 4/2003 Koyama ..... 345/204
2003/0085862 A1 5/2003 Tsutsui
2003/0098828 A1 * 5/2003 Hunter et al. ..... 345/76
2003/0098860 A1 * 5/2003 Nakamura et al. ..... 345/211
2003/0174153 A1 9/2003 Koyama
2003/0214493 A1 * 11/2003 Akimoto et al. ..... 345/204
2004/0038446 A1 2/2004 Takeda et al.
2004/0095364 A1 5/2004 Koyama et al.
2004/0127038 A1 7/2004 Carcia et al.
2004/0155873 A1 * 8/2004 Miyazawa ..... 345/204
2004/0189630 A1 9/2004 Huh et al.
2004/0257359 A1 * 12/2004 Muroi et al. ..... 345/212
2005/0007392 A1 1/2005 Kasai et al.
2005/0012731 A1 1/2005 Yamazaki et al.
2005/0017963 A1 1/2005 Yamazaki et al.
2005/0017964 A1 1/2005 Yamazaki et al.
2005/0093464 A1 * 5/2005 Shin et al. ..... 315/169.1
2005/0127846 A1 6/2005 Kim
2005/0140641 A1 6/2005 Kim et al.
2005/0181821 A1 * 8/2005 Elomaa ..... 455/550.1
2005/0190142 A1 9/2005 Ferguson
2005/0206588 A1 9/2005 Min et al.
2005/0275038 A1 12/2005 Shih et al.
2006/0055629 A1 3/2006 Van Woudenberg
2006/0082568 A1 4/2006 Yamazaki et al.
2006/0086933 A1 4/2006 Iechi et al.
2006/0108529 A1 5/2006 Saito et al.
2006/0108636 A1 5/2006 Sano et al.
2006/0114213 A1 6/2006 Yokoyama
2006/0170111 A1 8/2006 Isa et al.
2006/0197092 A1 9/2006 Hoffman et al.
2006/0228974 A1 10/2006 Thelss et al.
2006/0244702 A1 11/2006 Yamazaki et al.
2006/0262066 A1 11/2006 Yamazaki et al.
2006/0273999 A1 12/2006 Yamazaki et al.
2006/0286737 A1 12/2006 Levy et al.
2007/0004202 A1 1/2007 Fujii
2007/0026580 A1 2/2007 Fujii
2007/0054507 A1 3/2007 Kaji et al.
2007/0072439 A1 3/2007 Akimoto et al.
2007/0108446 A1 5/2007 Akimoto
2007/0146354 A1 6/2007 Kubota
2007/0272922 A1 11/2007 Kim et al.
2008/0006877 A1 1/2008 Mardilovich et al.
2008/0024091 A1 1/2008 Yamazaki et al.
2009/0102749 A1 * 4/2009 Kawabe ..... 345/45
2009/0141202 A1 6/2009 Yoshida
2010/0066653 A1 3/2010 Yamazaki et al.

FOREIGN PATENT DOCUMENTS

CN 1514426 7/2004
EP 1058234 A1 12/2000
EP 1 103 946 A2 5/2001
EP 1 111 577 6/2001
EP 1 184 833 A2 3/2002

(56) References Cited

FOREIGN PATENT DOCUMENTS

| | | | |
|---|---|---|---|
| EP | 1189192 | A | 3/2002 |
| EP | 1 249 822 | | 10/2002 |
| EP | 1 298 637 | A2 | 4/2003 |
| EP | 1 538 591 | | 6/2005 |
| GB | 2 177 829 | | 1/1987 |
| JP | 08-069690 | | 3/1996 |
| JP | 11-133921 | | 5/1999 |
| JP | 2001-324958 | | 11/2001 |
| JP | 2001 -343933 | | 12/2001 |
| JP | 2002091396 | A | 3/2002 |
| JP | 2002-108285 | | 4/2002 |
| JP | 2002-149113 | | 5/2002 |
| JP | 2003-186455 | | 7/2003 |
| JP | 2004070074 | A | 3/2004 |
| JP | 2004077742 | A | 3/2004 |
| JP | 2004163774 | A | 6/2004 |
| JP | 2004212924 | A | 7/2004 |
| JP | 2005043460 | A | 2/2005 |
| JP | 2005510768 | A | 4/2005 |
| JP | 2007-096055 | | 4/2007 |
| TW | 78107405 | | 1/1999 |
| WO | 03046877 | A1 | 6/2003 |
| WO | 2004/059605 | | 7/2004 |

OTHER PUBLICATIONS

European Search Report (Application No. 06 009 376.2), dated Aug. 22, 2006, 8 pages.

European Search Report (Application No. 06 007 738.5), dated May 25, 2007, 7 pages.

European Office Action (Application No. 06 009 376.2), dated Apr. 23, 2008, 9 pages.

Asakuma, et al., "Crystallization and Reduction of Sol-Gel-Derived Zinc Oxide Films by Irradiation with Ultraviolet Lamp," Journal of Sol-Gel-Science and Technology, vol. 26, pp. 181-184, Jan. 1, 2003.

Chinese Office Action (Application No. 201110391649.7) Dated Nov. 19, 2013, with Full English translation.

* cited by examiner

METHOD FOR DRIVING DISPLAY DEVICE IN WHICH ANALOG SIGNAL AND DIGITAL SIGNAL ARE SUPPLIED TO SOURCE DRIVER

BACKGROUND OF THE INVENTION

1. Field of the Invention

The present invention relates to a method for driving a display device.

2. Description of the Related Art

In recent years, a so-called self-luminous display device in which a pixel is formed using a light emitting element such as a light emitting diode (LED) has attracted attention. As a light emitting element used for such a self-luminous display device, an organic light emitting diode (also referred to as an OLED, an organic EL element, an electroluminescent (EL) element, or the like) has attracted attention, and have been used for an EL display (for example, an organic EL display or the like). A light emitting element such as an OLED is of self-luminous type; therefore, it has advantages such as higher pixel visibility, no backlight, and higher response speed compared to a liquid crystal display. The luminance of a light emitting element is controlled by the value of the current flowing therethrough.

Driving methods to control light emission gray scales of such a display device include a digital gray scale method and an analog gray scale method. In the digital gray scale method, a light emitting element is turned on/off by controlling in a digital manner to express a gray scale. On the other hand, in the analog gray scale method, there is a method of controlling the light emission intensity of a light emitting element in an analog manner and a method of controlling the light emission time of a light emitting element in an analog manner.

In the case of the digital gray scale method, there are only two states; a light emitting state and a non-light emitting state. So only two gray scale levels can be expressed. Therefore, multiple gray scale display is attempted by using another method in combination with the digital gray scale method. As the method for achieving multiple gray scale, a time gray scale method is often used (see Reference 1: Japanese Patent Laid-Open No. 2001-324958 and Reference 2: Japanese Patent Laid-Open No. 2001-343933).

Displays in which a display mode is controlled in a digital manner and a time gray scale method is combined to express a gray scale, include displays other than an organic EL display using a digital gray scale method. An example thereof is a plasma display.

The time gray scale method is a method for expressing a gray scale by controlling the length of a light emitting period or the number of light emissions. In other words, one frame is divided into a plurality of subframes, each of which is weighted by the number of light emissions, a light emitting period, or the like, and the total weight (the sum of the number of light emissions or the sum of the light emitting periods) is differentiated for each gray scale level, thereby expressing a gray scale.

Thus, there are an analog gray scale method and a digital gray scale method; however, both methods have advantages and disadvantages, and there has been no method that combines the advantages of both methods. Therefore, the method has to be limited to either of them.

For example, in the case of an analog gray scale method, a gray scale is displayed smoothly, whereas noise is also displayed together or contrast is decreased.

SUMMARY OF THE INVENTION

In view of such problems as described above, it is an object of the present invention to provide a display device which has the advantages of both an analog gray scale method and a digital gray scale method and which can perform high-contrast clear display.

The present invention provides a display device including a means that can perform display in a plurality of display modes. In other words, an analog signal and a digital signal are switched and input to a source driver. In addition, the display device includes a means that switches and outputs an analog signal and a digital signal. By using such means, the display device can have the advantages of both the analog gray scale method and the digital gray scale method, thereby achieving the above object.

A display device of the present invention is a display device in which a plurality of pixels is arranged in matrix. The display device includes a source driver and a gate driver, and at least two display modes, in which an analog signal is supplied to the source driver in a first display mode, and a digital signal is supplied to the source driver in a second display mode.

The present invention is a display device in which a plurality of pixels is arranged in matrix. The display device includes a source driver and a gate driver, and at least two display modes, in which an analog signal is supplied to the source driver and an analog signal is supplied to the pixel from the source driver in a first display mode, and a digital signal is supplied to the source driver and a digital signal is supplied to the pixel from the source driver in a second display mode.

In the present invention, a display device according to the above structure further includes a display mode-specific video signal generation circuit, in which the analog signal and the digital signal supplied to the source driver are output from the display mode-specific video signal generation circuit.

In the present invention, a display device according to the above structure further includes a display mode-specific video signal generation circuit including a binarization circuit, in which a video signal input to the display mode-specific video signal generation circuit is an analog signal, and a signal of the video signal used for the second display mode is converted into a digital signal using the binarization circuit. Alternatively, the display device may include a display mode-specific video signal generation circuit including a value multiplexing circuit, in which a video signal input to the display mode-specific video signal generation circuit is an analog signal, and a signal of the video signal used for the second display mode is converted into a digital signal using the value multiplexing circuit. Alternatively, the display device may include a display mode-specific video signal generation circuit including a digital analog converter circuit, in which a video signal input to the display mode-specific video signal generation circuit is a digital signal, and a signal of the video signal used for the first display mode is converted into an analog signal using the digital analog converter circuit.

Note that in the present invention, display modes are distinguished according to the number of gray scale levels; for example, the number of gray scale levels is different between the first display mode and the second display mode.

In the present invention, one pixel means one element that can control brightness. Therefore, one pixel means, for example, one color element, which expresses brightness. Accordingly, in the case of a color display device including color elements of R (Red), G (Green), and B (Blue), it is assumed that the smallest unit of an image is composed of three pixels of R, G. and B. Note that the color elements are not limited to three colors, and may be more than three colors, for example, RGBW (W is white).

Note that the phrase "pixels are arranged in matrix" in this specification includes the case where pixels are arranged in a so-called grid of a combination of vertical stripes and lateral stripes. It also includes the case where pixels of three color elements (for example, RGB) representing the smallest unit of one image are in so-called delta arrangement when full color display is performed with the three color elements. Furthermore, it also includes the case of Bayer arrangement. In addition, the color elements may each have different light emitting regions.

In the present invention, there is no limitation on the kind of applicable transistor. A thin film transistor (TFT) using a non-single crystal semiconductor film typified by an amorphous silicon film or a polycrystalline silicon film, a MOS transistor formed using a semiconductor substrate or an SOI substrate, a junction transistor, a bipolar transistor, a transistor using an organic semiconductor or a carbon nanotube, or another transistor can be used. Note that the non-single crystal semiconductor film may contain hydrogen or halogen. In addition, there is no limitation on the kind of substrate over which the transistor is to be located. The transistor can be located over a single-crystal substrate, an SOI substrate, a glass substrate, a plastic substrate, a paper substrate, a cellophane substrate, a stone substrate, or the like. Further, the transistor may be formed over one substrate, and later, may be transferred to and located over another substrate.

Note that as described above, the transistor in the present invention may be of any kind and may be formed over any substrate. Therefore, all circuits may be formed over a glass substrate, a plastic substrate, a single-crystal substrate, an SOI substrate, or any other type of substrate. By forming all circuits over one substrate, the number of components can be reduced to reduce cost and the number of connections with circuit components can be reduced to improve reliability and the like. Alternatively, part of circuits may be formed over one substrate and another part of circuits may be formed over another substrate. In other words, all circuits are not necessarily formed over one substrate. For example, part of circuits may be formed using transistors over a glass substrate and as another part of circuits, an IC chip formed over a single-crystal substrate or the like may be arranged over the glass substrate by connecting by COG using a (Chip On Glass) method. Alternatively, the IC chip may be connected to the glass substrate by using a TAB (Tape Automated Bonding) method or a printed wiring board. Thus, by forming part of circuits over one substrate, the number of components can be reduced to reduce cost and the number of connections with circuit components can be reduced to improve reliability and the like. In addition, a portion with high drive voltage and a portion with high drive frequency consume a large amount of power. Therefore, by preventing such portions from being formed over the same substrate, an increase in power consumption can be prevented.

Note that a switch to be described in this specification can be of various types, one example of which is an electric switch, a mechanical switch, or the like. In other words, any switch that can control current flow can be used, and there is no particular limitation. For example, the switch may be a transistor, a diode (such as a PN diode, a PIN diode, a Schottky diode, or a diode-connected transistor), or a logic circuit that is a combination thereof. In the case of using a transistor as the switch, the transistor operates as a mere switch. Therefore, the polarity (conductivity type) of the transistor is not particularly limited. However, it is desirable to use a transistor having a polarity with lower off-current. As the transistor with low off-current, a transistor provided with an LDD region, a transistor having a multi-gate structure, or the like can be used. In addition, it is desirable to use an n-channel transistor when a transistor to be operated as a switch operates in a state where a potential of a source electrode thereof is close to a lower potential side power source (such as Vss, GND, or 0 V), whereas it is desirable to use a p-channel transistor when a transistor operates in a state where a potential of a source electrode thereof is close to a higher potential side power source (such as Vdd). This is because the absolute value of a gate-source voltage can be increased, so that the transistor easily operates as a switch. Note that the switch may be of CMOS type using both an n-channel transistor and a p-channel transistor. If the switch is of CMOS type, it can operate appropriately because output voltage can be easily controlled with respect to various input voltages.

Note that in the present invention, the phrase "being connected" is synonymous with being electrically connected. Therefore, in the constitution disclosed in the present invention, another element (such as a switch, a transistor, a capacitor element, an inductor, a resistor element, or a diode) which enables electrical connection may be interposed in a predetermined connection. Naturally, components may be arranged without another element interposed therebetween, and the phrase "being electrically connected" includes the case of being directly connected.

According to the present invention, display can be performed while switching an analog gray scale method and a digital gray scale method. Consequently, display quality such as contrast can be improved, and power consumption can be reduced.

DETAILED DESCRIPTION OF THE INVENTION

Hereinafter, embodiment modes of the present invention are explained with reference to the drawings. However, the present invention is not limited to the following description. As is easily understood to a person skilled in the art, the mode and the detail of the invention can be variously changed without departing from the spirit and the scope of the present invention. Thus, the present invention is not interpreted while limiting to the following description of the embodiment modes.

(Embodiment Mode 1)

Figure 1:
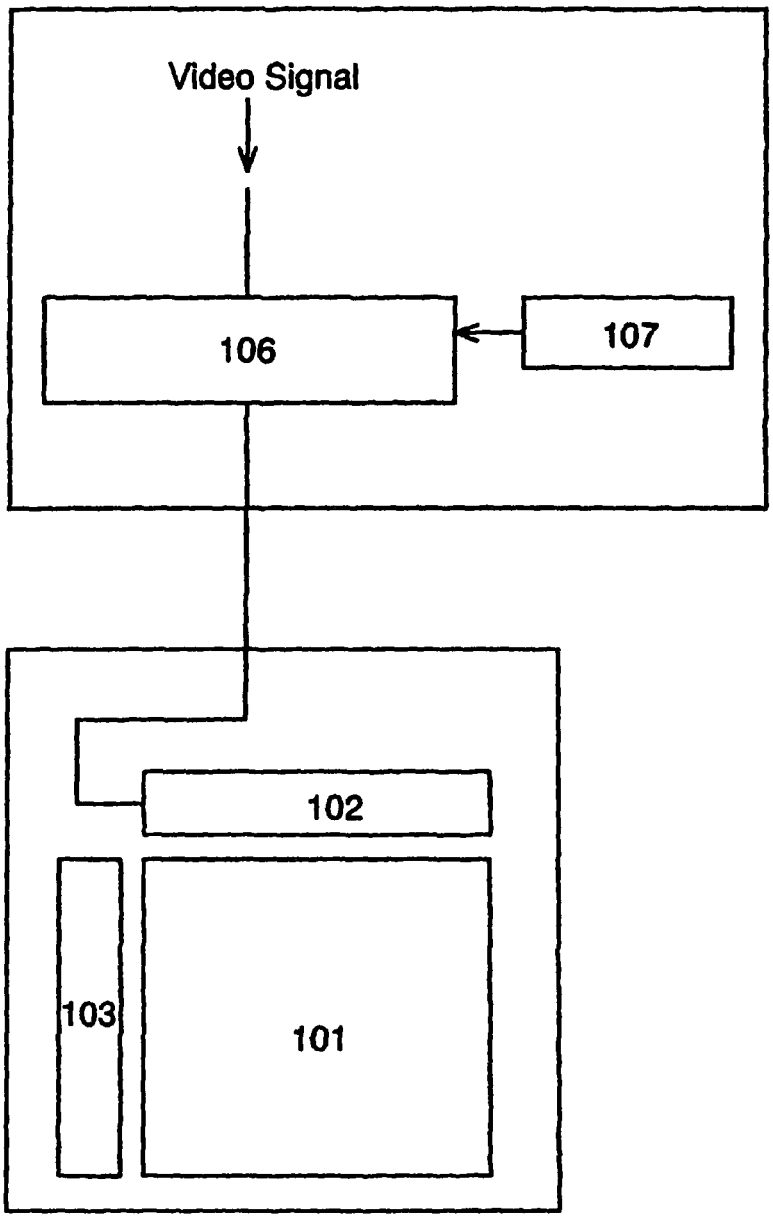
FIG. 1 is a diagram explaining a structure of a display device of the present invention.

An overall configuration diagram is shown in FIG. 1. A source driver 102 and a gate driver 103 are provided to drive a pixel array 101. A video signal is input to the source driver 102. Note that a plurality of source drivers 102 and gate drivers 103 may each be provided.

Note that the source driver or part thereof may be formed using, for example, an external IC chip without existing over the same substrate as the pixel array 101.

Note that the transistor in the present invention may be of any type and may be formed over any substrate as described above. Therefore, such circuits as shown in FIG. 1 may all be formed over a glass substrate, a plastic substrate, a single crystalline substrate, an SOI substrate, or any other substrate. Alternatively, part of circuits shown in FIG. 1 or the like may be formed over a certain substrate and another part thereof shown in FIG. 1 or the like may be formed over another substrate. In other words, all circuits shown in FIG. 1 or the like are not necessarily formed over one substrate. For example, in FIG. 1 or the like, the pixel array 101 and the gate driver 103 may be formed using TFTs over a glass substrate, the source driver 102 (or part thereof) may be formed over a single crystalline substrate, and an IC chip thereof may be connected by using a COG (Chip On Glass) method and provided over the glass substrate. Alternatively, the IC chip may be connected to the glass substrate by using a TAB (Tape Automated Bonding) method or a printed circuit board.

The video signal input to the source driver 102 is generated in a display mode-specific video signal generation circuit 106 in accordance with each display mode. The display mode-specific video signal generation circuit 106 is controlled using a controller (control circuit) 107. An original video signal is input to the display mode-specific video signal generation circuit 106. Then, the video signal in accordance with each display mode is generated in the display mode-specific video signal generation circuit 106 using the original video signal and is output to the source driver 102.

The display modes can be roughly divided into an analog mode and a digital mode. In the analog mode, a video signal input to a pixel is an analog value. On the other hand, in the digital mode, a video signal input to a pixel is a digital value.

Figure 2:
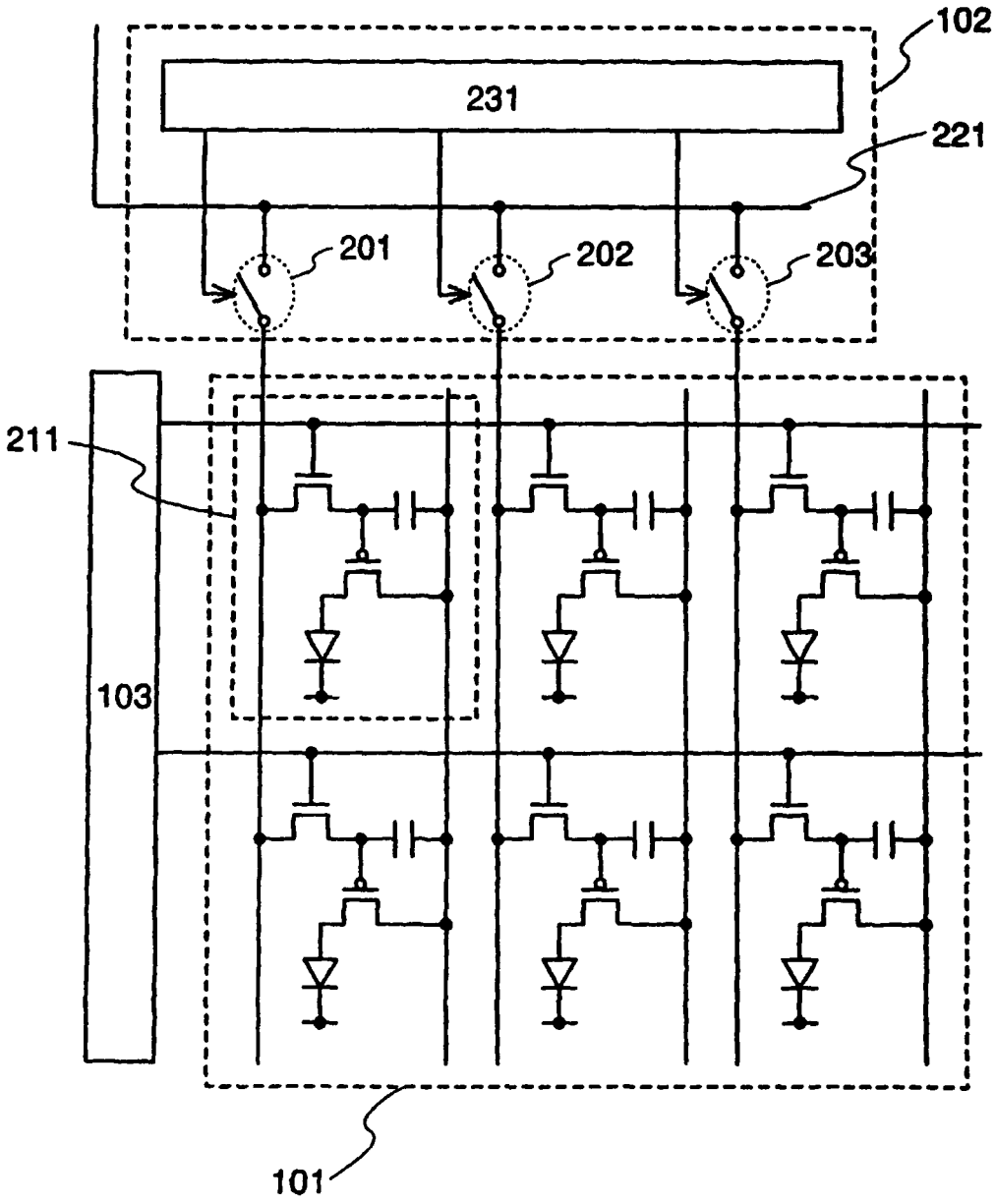
FIG. 2 is a diagram explaining a structure of a display device of the present invention.

Subsequently, details of a circuit are described. FIG. 2 shows the structure of the source driver 102 and so on. A shift register 231 is a circuit which outputs a sequentially selecting signal (a so-called sampling pulse). Therefore, the circuit is not limited to the shift register as long as a circuit that performs a similar function is used. For example, a decoder circuit may be used.

The sampling pulse output from the shift register is input to analog switches 201 to 203. Then, video signals are sequentially input to a video signal line 221; the analog switches 201 to 203 are sequentially turned on in accordance with the sampling pulse; and the video signals are input to the pixel array 101. In the pixel array 101, pixels 211 are arranged in matrix.

Note that FIG. 2 shows the case where two rows and three columns of pixels 211 are arranged, but the invention is not limited thereto. Any number of pixels can be arranged.

Figure 15:
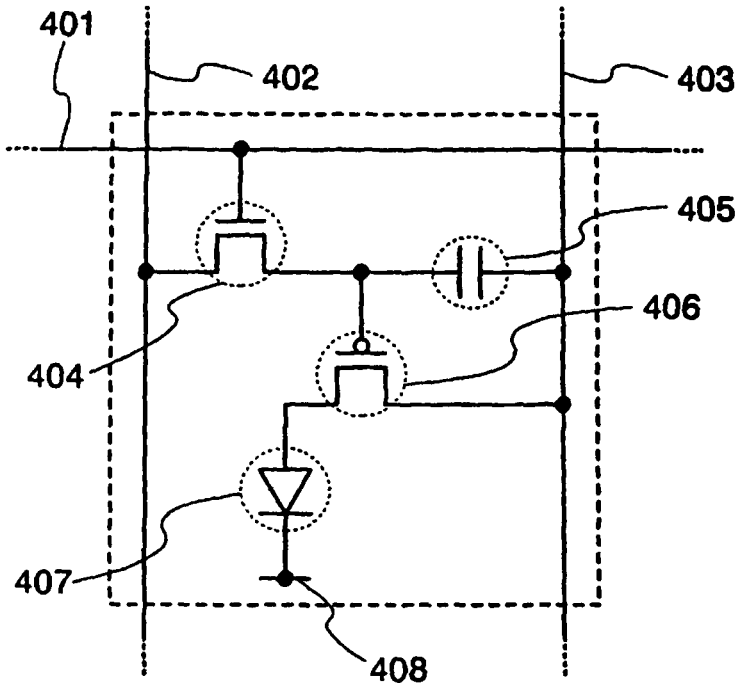
FIG. 15 is a diagram explaining a structure of a pixel in a display device of the present invention.

FIG. 15 shows an example of one pixel 220. A selection transistor 404 is controlled using a gate signal line 401. If the selection transistor 404 is turned on, a video signal is input to a storage capacitor 405 from a source signal line 402. Then, a driver transistor 406 is turned on or off in accordance with the video signal, and current flows to an opposite electrode 408 from a power supply line 403 through a light emitting element 407.

Note that a pixel structure is not limited to that shown in FIG. 15. For example, a structure which corrects variations in the driver transistors may be employed.

The pixel structures which correct variations can be roughly divided into two types: one is that corrects variations in threshold voltage and the other is that inputs current as a video signal.

Figure 31:
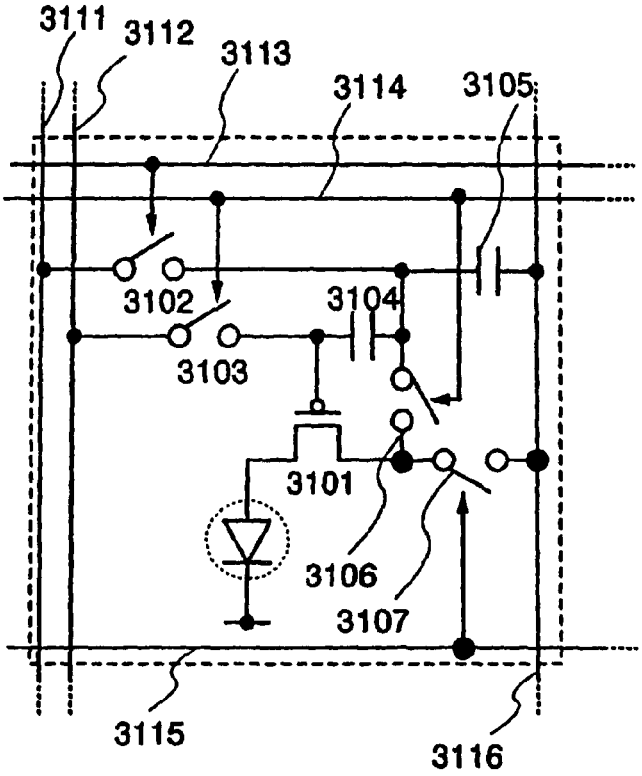
FIG. 31 is a diagram explaining a part of a structure of a display device of the present invention.

FIG. 31 shows the pixel structure which corrects variations in threshold voltage. A threshold voltage of a driver transistor 3101 is stored in a capacitor element 3104 by controlling a switch 3107 using a gate signal line 3115. A switch 3103 controlled by a gate signal line 3114 serves to initialize the gate potential of the driver transistor 3101. Then, a video signal is input from a source signal line 3111 through a switch 3102. Note that the selection transistor 404 in FIG. 15 corresponds to the switch 3102 in FIG. 31; the storage capacitor 405, to a capacitor element 3105; and the driver transistor 406, to the driver transistor 3101. In addition, the gate signal line 401 corresponds to a gate signal line 3113; the source signal line 402, to the source signal line 3111; and the power supply line 403, to a power supply line 3116.

Figure 32:
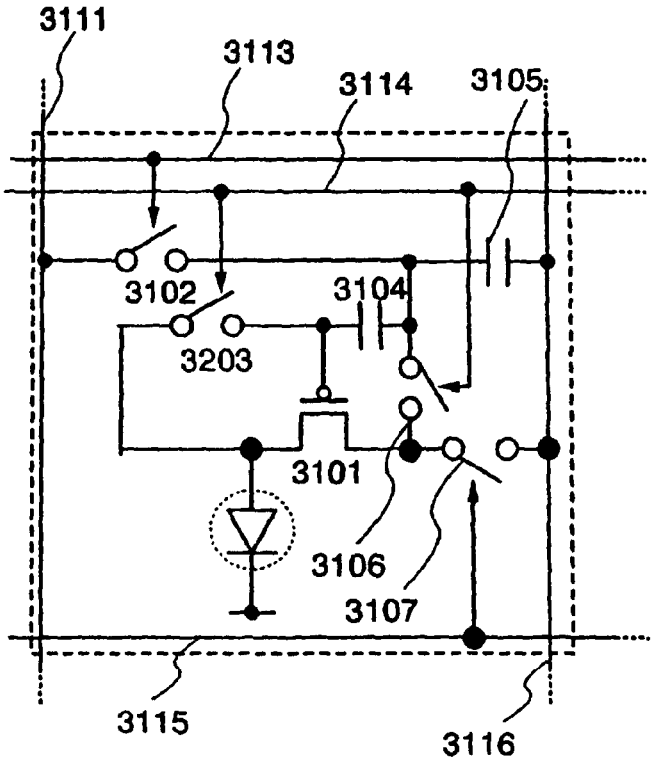
FIG. 32 is a diagram explaining a structure of a pixel in a display device of the present invention.

In FIG. 31, a wire 3112 for initializing the gate potential of the driver transistor 3101 is necessary. A structure where the wire 3112 is removed from FIG. 31 is shown in FIG. 32. A gate of the driver transistor 3101 is connected to a drain of the driver transistor 3101 through a switch 3203.

Note that there are various pixel structures which correct variations in threshold voltage, and the invention is not limited to the structures shown in FIGS. 31 and 32. By using the pixel structure which corrects variations in threshold voltage as described above, variations of current flowing to the light emitting elements can be reduced. In particular, luminance can be equalized in an analog mode. Therefore, the pixel structure which corrects variations in threshold voltage is more suitable.

Figure 33:
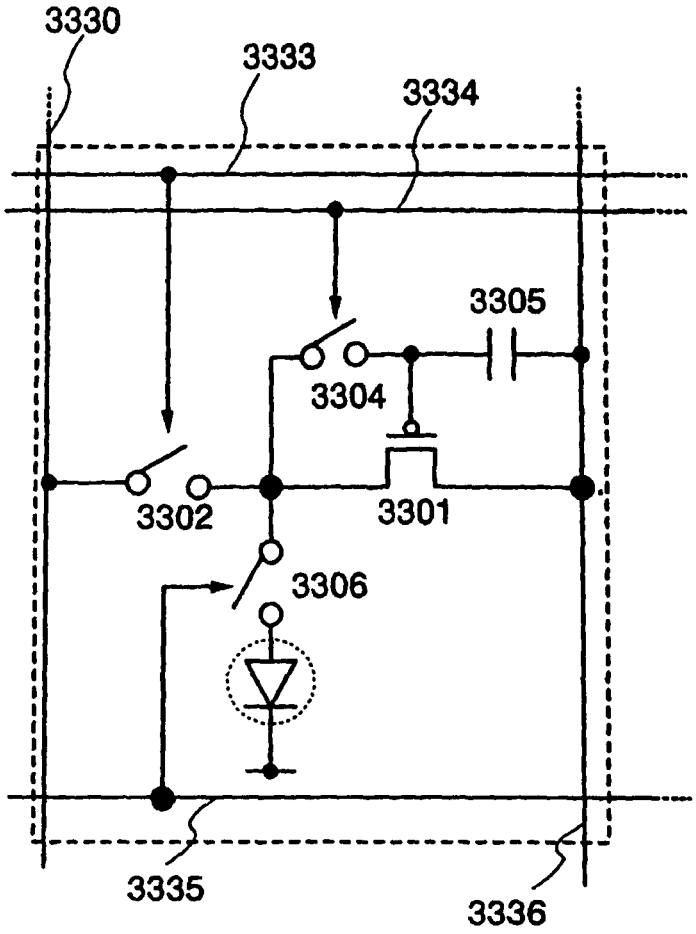
FIG. 33 is a diagram explaining a structure of a pixel in a display device of the present invention.
Figure 34:
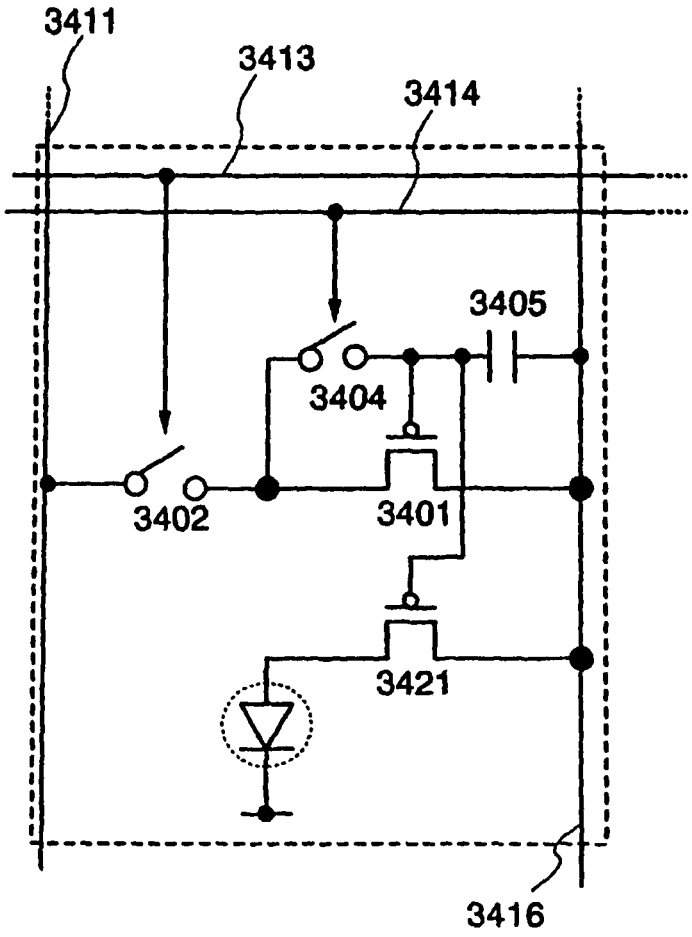
FIG. 34 is a diagram explaining a structure of a pixel in a display device of the present invention.

Next, the pixel structure to which current is input as a video signal is shown in FIG. 33. A current in accordance with a video signal is supplied to a source signal line 3330. Then, the current flows to a drain of a driver transistor 3301 through a switch 3302 and to a gate of the driver transistor 3301 through a switch 3304; accordingly, a gate-source voltage is generated. The gate-source voltage is stored in a capacitor element 3305; thereafter, a current is supplied to a light emitting element through a switch 3306. Note that the switch 3302, the switch 3304, and the switch 3306 are controlled by a gate signal line 3333, a gate signal line 3334, and a gate signal line 3335, respectively. Note that reference numeral 3336 denotes a power supply line. Note that a transistor to which a signal current is supplied is identical with a transistor for supplying current to a light emitting element in FIG. 33; however, they may be different from each other. That case is shown in FIG. 34. A transistor 3401 to which a signal current is supplied and a transistor 3421 for supplying current to a light emitting element are different. Note that 3411 denotes a source signal line; 3413 and 3414, gate signal lines; 3402, a selection switch; 3404, a switch; 3405, a capacitor element; 3416, a power supply line in FIG. 34.

Note that there are various types of pixel structures which correct variations by inputting current, and the invention is not limited to the structures shown in FIGS. 33 and 34. By using the pixel structure which corrects variations by inputting current as described above, variations in current flowing to the light emitting element can be reduced. In particular, luminance can be equalized in an analog mode. Therefore, the pixel structure which corrects variations by inputting a current is more suitable.

Note that a light emitting element arranged in a pixel is not limited to a specific one. As the light emitting element arranged in a pixel, a display medium in which contrast varies by an electromagnetic action can be used, such as an EL (electroluminescent) element (such as an organic light emitting diode (also referred to as an OLED, an organic EL element, or the like), an inorganic EL element, or an EL element containing an organic material and an inorganic material), an electron emitting element, a liquid crystal element, electronic ink, or the like. In addition, a carbon nanotube can be used as the electron emitting element. Note that as an example of a display device using the electron emitting element, a field emission display (FED), an SED (Surface-conduction Electron-emitter Display) that is a kind of FED, or the like can be given. Furthermore, any display element that is used for a liquid crystal display (LCD), a plasma display (PDP), an electronic paper display, a digital micromirror device (DMD), a piezoelectric ceramic display, or the like may be used.

Note that the storage capacitor 405 in FIG. 15 serves to hold the gate potential of the driver transistor 406. Therefore, it is connected between a gate of the driver transistor 406 and the power supply line 403, but the invention is not limited thereto. The storage capacitor 405 may be positioned so as to be able to store the gate potential of the driver transistor 406. In the case where the gate potential of the driver transistor 406 can be held using the gate capacitance of the driver transistor 406 or the like, the storage capacitor 405 may be omitted.

The display mode-specific video signal generation circuit 106 in FIG. 1 may be located over the same substrate as the pixel array 101, the same substrate as the source driver 102, or may be on an FPC (flexible printed circuit), or a PCB (printed circuit board).

In addition, the display mode-specific video signal generation circuit 106 may be formed with a transistor similar to that included in the pixel array 101. Alternatively, it may be formed with another transistor. For example, the pixel array 101 may include a thin film transistor, and the display mode-specific video signal generation circuit 106 may be formed with a MOS transistor or a bipolar transistor formed over a bulk substrate or an SOI substrate.

Figure 3:
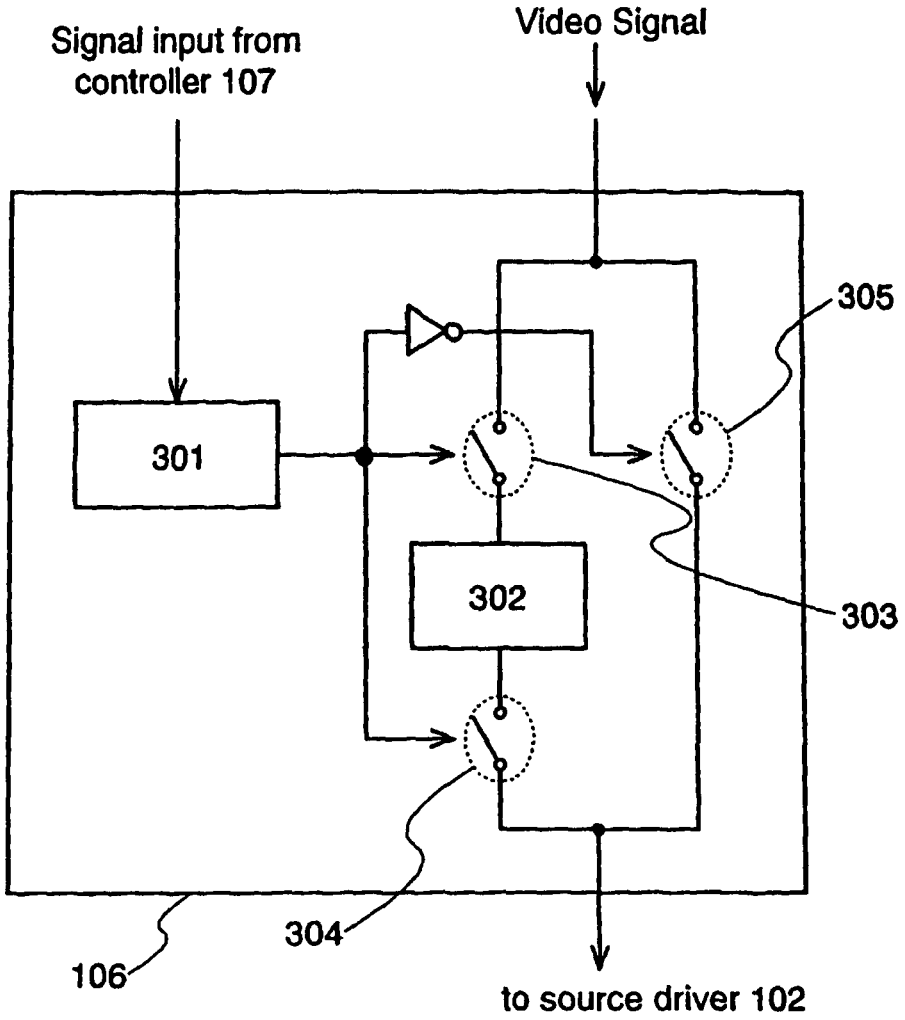
FIG. 3 is a diagram explaining a structure of a part of a display device of the present invention.

Next, details of the display mode-specific video signal generation circuit 106 are shown in FIG. 3. Based on a signal input from the controller 107, a display mode control circuit 301 performs control so that display according to a display mode can be performed. For example, in the case of a digital mode, switches 303 and 304 are turned on. Then, the input video signal is processed by a binarization circuit 302 and is output to the source driver 102. In that case, a switch 305 is in an off state. On the other hand, in the case of an analog mode, the switch 305 is turned on, and the input video signal is output to the source driver 102 without any change. In the case where the video signal input to the display mode-specific video signal generation circuit 106 is an analog value, the video signal is output without any change; therefore, the video signal is output as an analog value also to the source driver 102.

In FIG. 3, the case where the display mode is in an analog mode and in a digital mode is shown; however, the invention is not limited thereto. Note that a display mode where a video signal is a discrete value but not a binary value is referred to as a multi-valued mode. Examples of the relationship between a video signal and luminance are shown in FIGS. 4A to 4C.

Figure 4A:
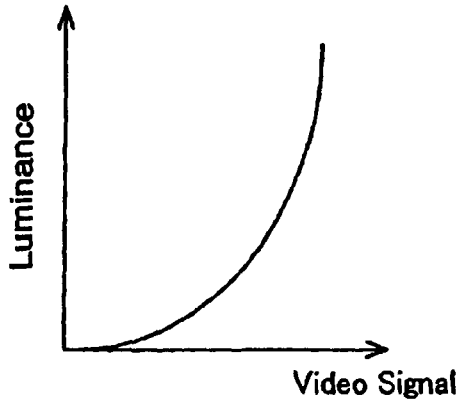
FIGS. 4A to 4C are diagrams explaining methods for driving display devices of the present invention.

FIG. 4A shows the case of an analog mode. A video signal varies in an analog manner, and accordingly, luminance also varies in an analog manner.

Figure 4B:
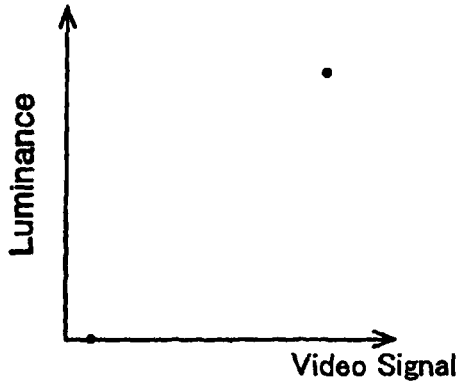

FIG. 4B shows the case of a digital mode. A video signal is a binary value, and light is emitted at one value and not emitted at the other.

Figure 4C:
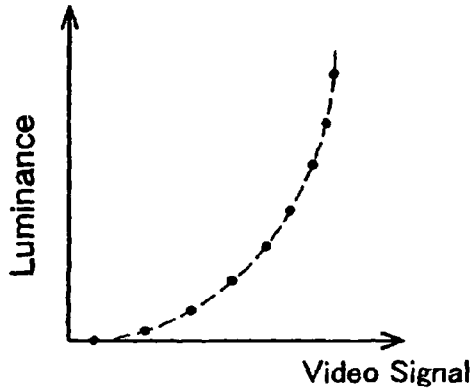

FIG. 4C shows the case of a multi-valued mode. A video signal takes a discrete value, but not a binary value. Note that in the multi-valued mode, display is performed using a multi-valued digital signal output from the display mode-specific video signal generation circuit 106.

Figure 5:
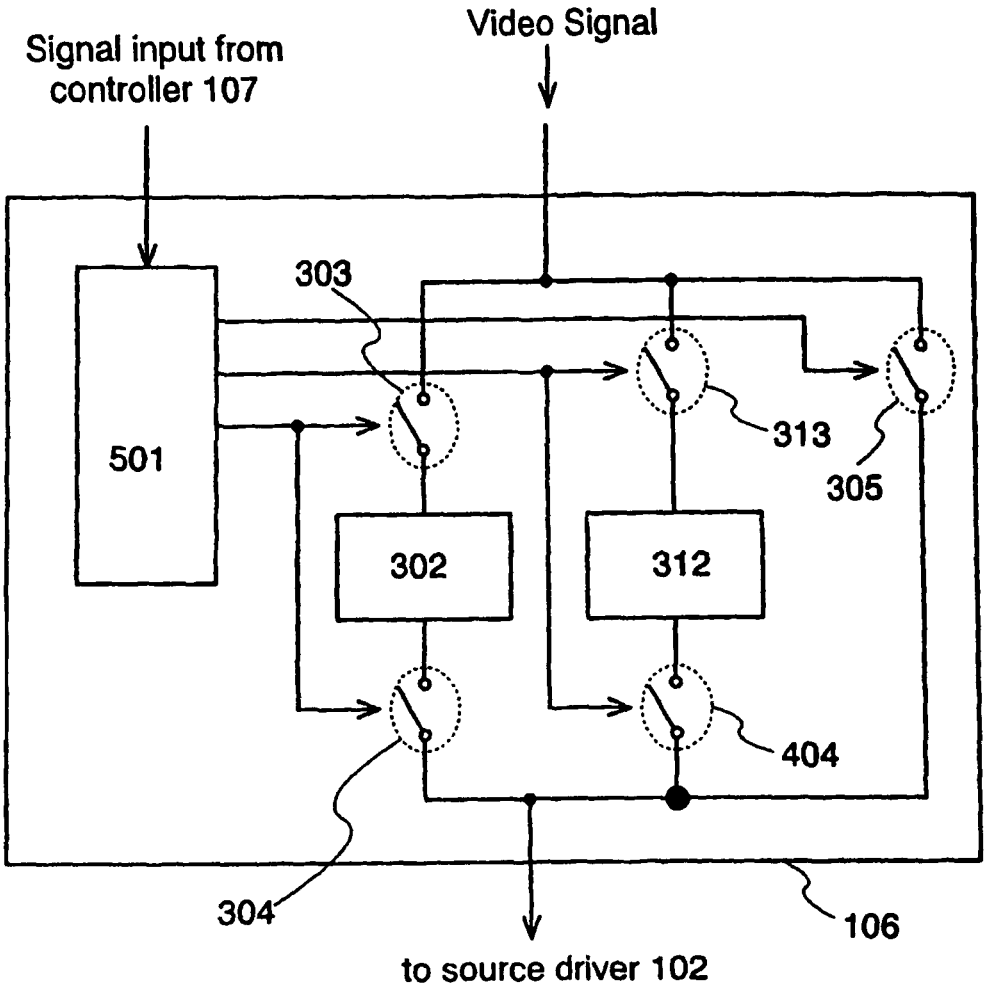
FIG. 5 is a diagram explaining a structure of a part of a display device of the present invention.

Then, details of the display mode-specific video signal generation circuit 106 corresponding also to the case of the multi-valued mode are shown in FIG. 5. Based on a signal input from the controller 107, a display mode control circuit 501 performs control so that display according to a display mode can be performed. For example, in the case of a digital mode, switches 303 and 304 are turned on. Then, the input video signal is processed by a binarization circuit 302 and is output to the source driver 102. In that case, switches 313, 404, and 305 are in an off state. On the other hand, in the case of an analog mode, the switch 305 is turned on, and the input video signal is output to the source driver 102 without any change. In the case where the video signal input to the display mode-specific video signal generation circuit 106 is an analog value, the video signal is output without any change; therefore, the video signal is output as an analog value also to the source driver 102. In the case of a multi-valued mode, the switches 313 and 404 are turned on. Then, the input video signal is processed by a value multiplexing circuit 312 and is output to the source driver 102. In that case, the switches 303, 304, and 305 are in an off state.

Figure 6A:
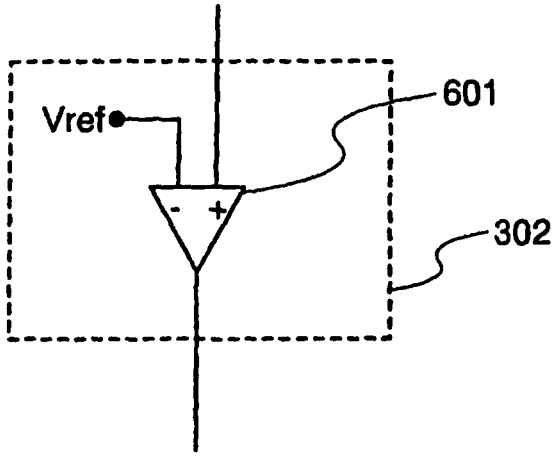
FIGS. 6A and 6B are diagrams explaining a part of a structure of a display device of the present invention.
Figure 6B:
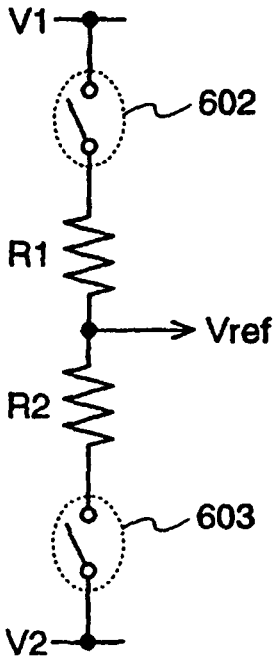

Next, details of the binarization circuit 302 are shown in FIGS. 6A and 6B. As shown in a circuit diagram of FIG. 6A, a comparator circuit is formed using an operational amplifier 601. The comparator circuit outputs the signal of H or L depending on whether an input voltage is higher or lower than a reference potential Vref to perform binarization. Note that the comparator circuit is formed using the operational amplifier, but the invention is not limited thereto. A chopper inverter comparator circuit may be used, or the comparator circuit may be formed using another circuit.

FIG. 6B shows a circuit for generating the reference potential Vref. The value of the reference potential Vref corresponds to the voltage between voltages V1 and V2 and becomes a value divided by resistors R1 and R2. Switches 602 and 603 may be turned on only when the binarization circuit is operated. Accordingly, a period during which current flows to the resistors R1 and R2 can be shortened, so that power consumption can be reduced.

Figure 7:
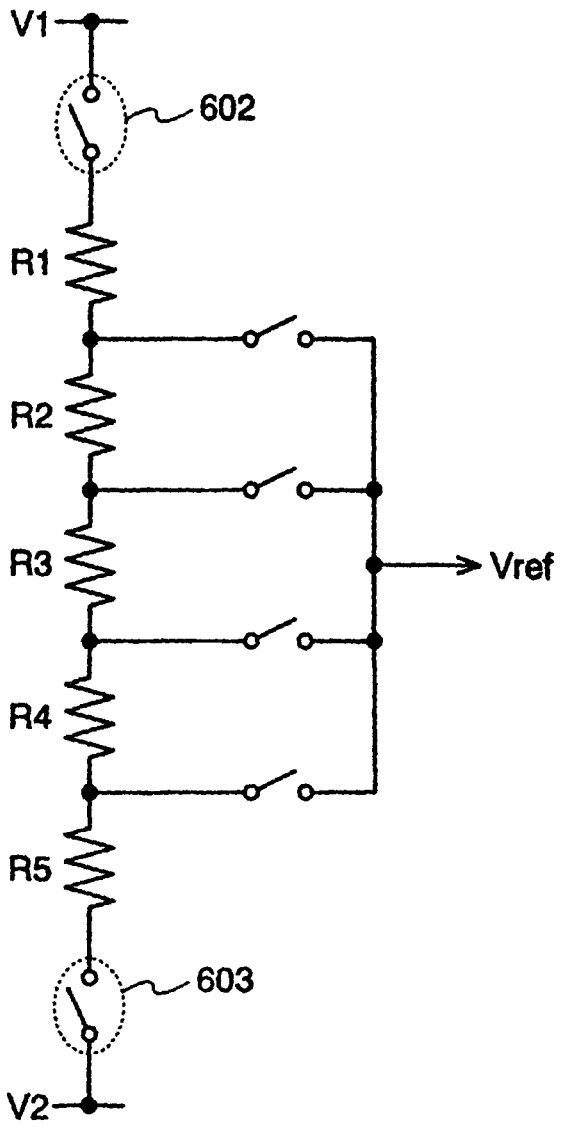
FIG. 7 is a diagram explaining a part of a structure of a display device of the present invention.

Note that when the reference potential Vref is desired to be changed depending on the situation, it is preferable that many resistors are connected as shown in FIG. 7 and contacts for outputting are switched.

Figure 8:
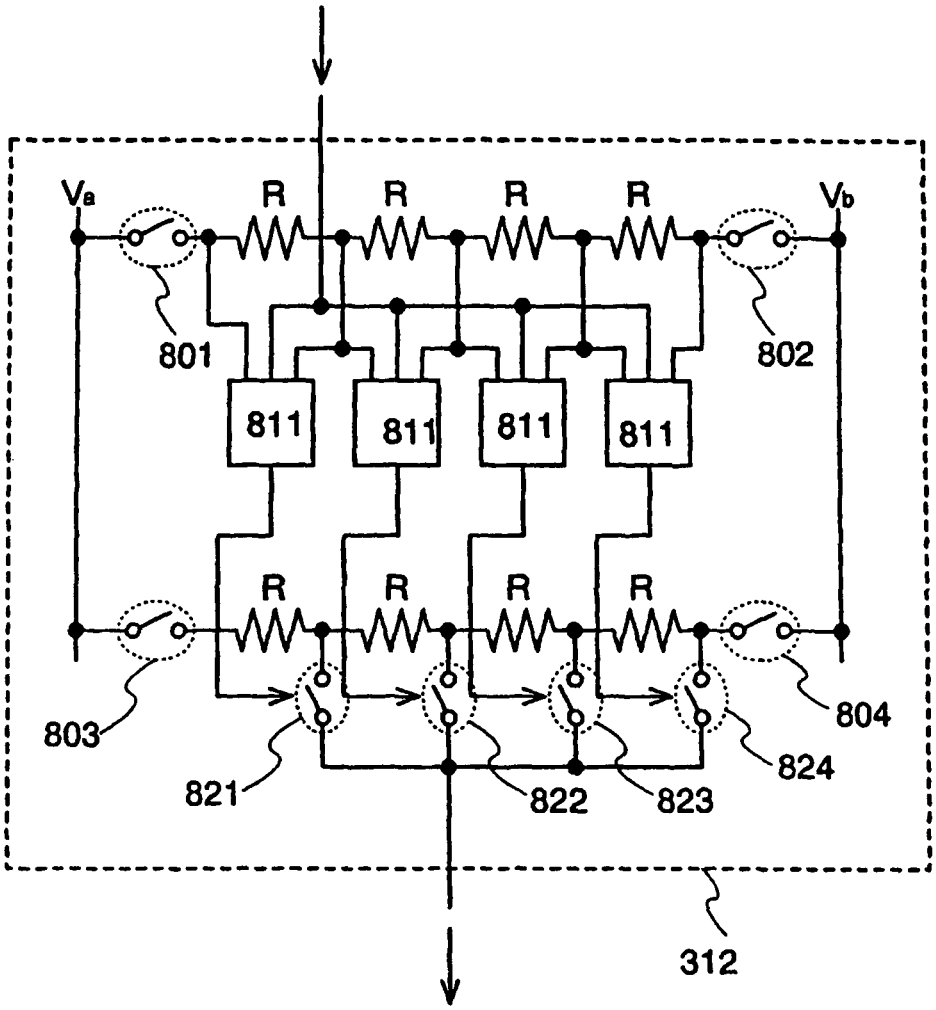
FIG. 8 is a diagram explaining a part of a structure of a display device of the present invention.

Details of the value multiplexing circuit 312 are shown in FIG. 8. An input signal is input to a determination circuits 811. In addition, two voltages corresponding to reference potentials are input to each of the determination circuit 811. The determination circuit 811 outputs an H signal when the potential of the input signal is between the two reference potentials. Accordingly, one of switches 821 to 824 is turned on, and a multi-valued voltage is output. Note that switches 801 to 804 may be turned on only when the value multiplexing circuit 312 is operated. Accordingly, a period during which current flows between Va and Vb can be shortened, so that power consumption can be reduced.

Figure 9:
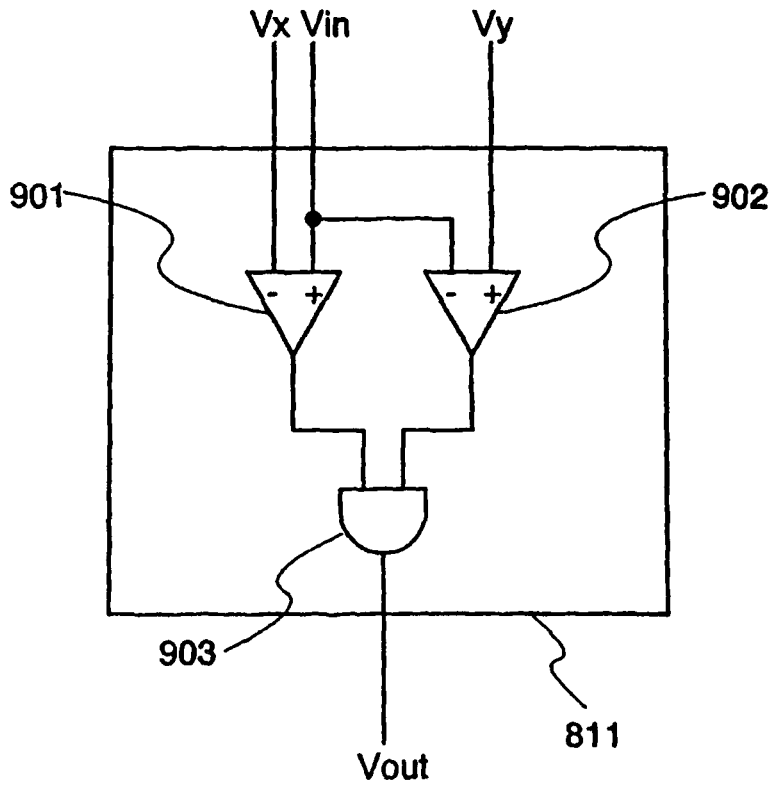
FIG. 9 is a diagram explaining a part of a structure of a display device of the present invention.

FIG. 9 shows details of the determination circuit 811. A comparator circuit is formed using operational amplifiers 901 and 902. Each of the operational amplifiers 901 and 902 outputs an H signal when the potential Vin of an input signal is in the range of a reference potential Vx to a reference potential Vy. Then, the signals are input to an AND circuit 903. When both of the input signals to the AND circuit 903 are H signals, an H signal is output.

Note that the determination circuit is formed using the AND circuit in FIG. 9, but the invention is not limited thereto. A similar function can also be performed when an OR circuit, a NAND circuit, or a NOR circuit is used.

When display is performed in a digital mode or a multi-valued mode, thresholding is performed and sampling of image information is performed. Accordingly, even an image data including noise can be displayed with the noise removed when the image is actually displayed. In addition, the image can be seen clearly because a luminance change in each gray scale level is significant, so that contrast is enhanced.

Note that the switches shown in FIGS. 2, 3, and 5, for example the analog switch 201, may each be an electrical switch, a mechanical switch, or any other switch. Any switch that can control current flow can be used. The switch may be a transistor, a diode, or a logic circuit that is a combination thereof. In the case of using a transistor as the switch, the transistor operates as a mere switch. Therefore, the polarity (conductivity type) of the transistor is not particularly limited. However, in the case where lower off-current is desired, it is desirable to use a transistor having a polarity with lower off-current. As the transistor with low off-current, a transistor provided with an LDD region, a transistor having a multi-gate structure, or the like can be used. In addition, it is desirable to use an n-channel transistor when a transistor to be operated as a switch operates in a state where a potential of a source terminal thereof is close to a lower potential side power source (such as Vss, Vgnd, or 0 V), whereas it is desirable to use a p-channel transistor when a transistor operates in a state where a potential of a source terminal thereof is close to a higher potential side power source (such as Vdd). This is because the absolute value of a gate-source voltage can be increased, so that the transistor easily operates as a switch. Note that the switch may be of a CMOS type using both an n-channel transistor and a p-channel transistor.

Figure 14A:
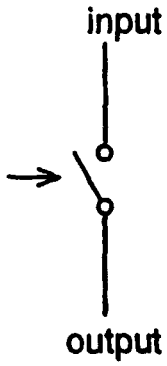
FIGS. 14A to 14D are diagrams explaining switches of the present invention.
Figure 14B:
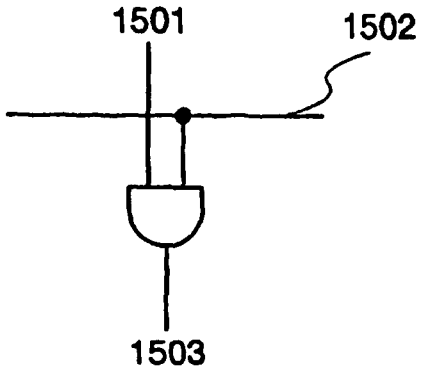

Examples of the switch are shown in FIGS. 14A to 14D. FIG. 14A schematically shows a switch. FIG. 14B shows a switch using an AND circuit. Whether or not a signal of an input 1501 is transmitted to an output 1503 is controlled using a control line 1502. In the case of FIG. 14B, control can be performed in such a way that the output 1503 is an L signal regardless of the input signal. However, the output 1503 is never in a floating state. Thus, the switch in FIG. 14B is suitably used such as when the output 1503 is connected to an input of a digital circuit. In the case of the digital circuit, an output is not put in a floating state even when an input is put in a floating state. When the input is put in a floating state, the output becomes unstable, which is not desirable. Therefore, it is preferable to use the switch in FIG. 14B such as when the output is connected to the input of a digital circuit.

Note that the switch in FIG. 14B is formed using the AND circuit, but the invention is not limited thereto. A similar function can also be performed when an OR circuit, a NAND circuit, or a NOR circuit is used.

Figure 14C:
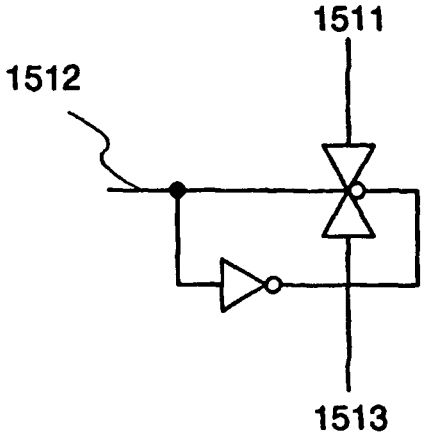
Figure 14D:
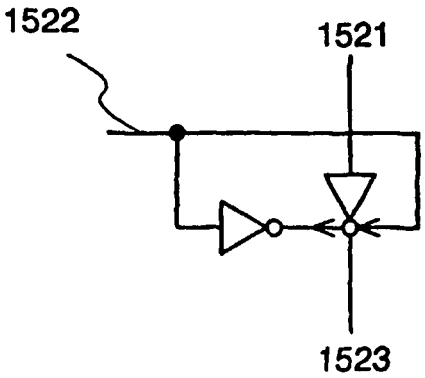

On the other hand, a switch in FIG. 14C or 14D may be used when the input is desired to be put in a floating state. The switch in FIG. 14C is a circuit referred to as a transmission gate, an analog switch, or the like. The switch in FIG. 14C transmits the potential of an input 1511 to an output 1513 with almost no change. Therefore, the switch is suitable for analog signal transmission. The switch in FIG. 14D is a circuit referred to as a clocked inverter or the like. The switch in FIG. 14D inverts and transmits a signal of an input 1521 to an output 1523. Therefore, the switch is suitable for digital signal transmission. Note that whether or not the signals of the inputs 1511 and 1521 are transmitted to the outputs 1513 and 1523 respectively is controlled using control lines 1512 and 1522.

According to the above, the switch in FIG. 14C is preferably used as the analog switch 201, the switch 305, the switch 602, the switch 801, or the like. The switch in FIG. 14C or 14D is suitable for the switch 304 or the like since the input thereof needs to be put in a floating state. Note that the output from the switch 304 is a digital signal; therefore, the switch in FIG. 14D is more suitable.

(Embodiment Mode 2)

The case where the video signal input to the display mode-specific video signal generation circuit 106 is an analog value is described in Embodiment Mode 1. Next, the case where a digital value is input is described.

Figure 24:
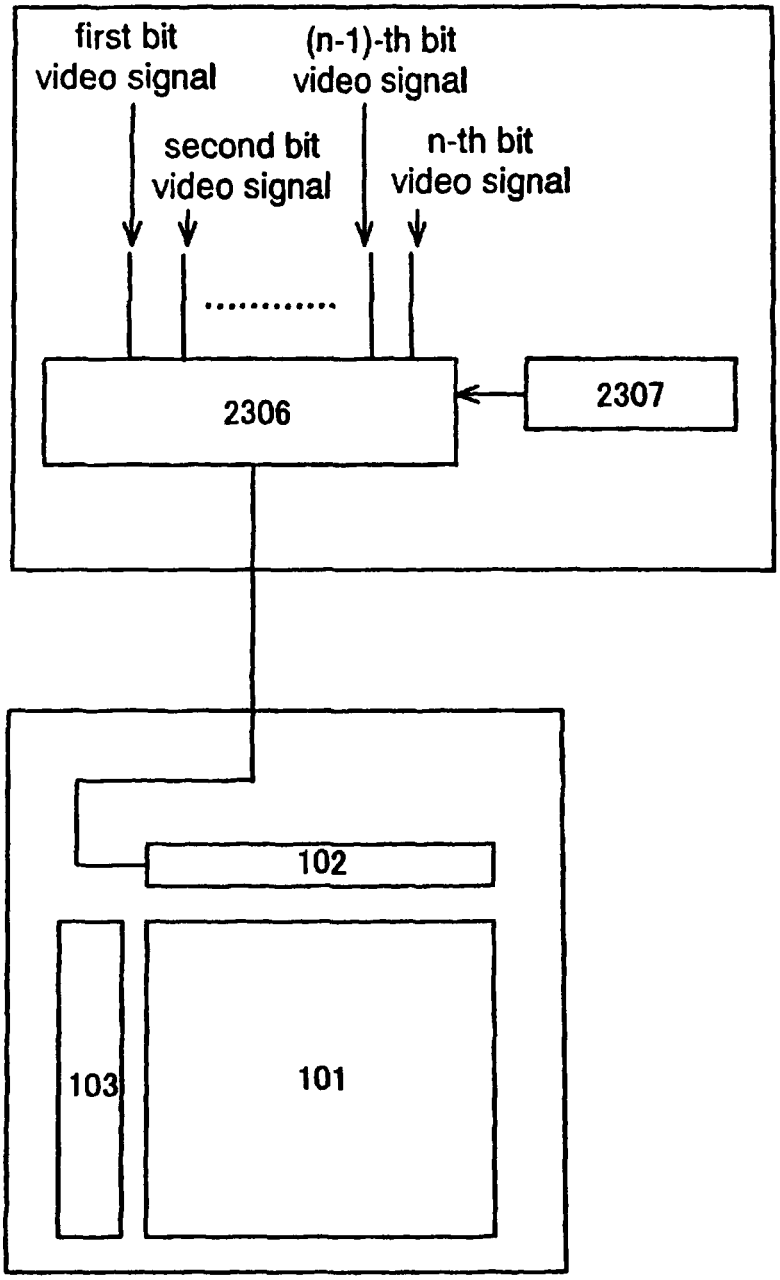
FIG. 24 is a diagram explaining a structure of a display device of the present invention.

FIG. 24 shows an overall configuration diagram. A video signal input to a source driver 102 is generated in a display mode-specific video signal generation circuit 2306 in accordance with each display mode. The display mode-specific video signal generation circuit 2306 is controlled using a controller 2307. An original digital video signal is input to the display mode-specific video signal generation circuit 2306. Then, using the original video signal, the video signal in accordance with each display mode is generated in the display mode-specific video signal generation circuit 2306 and is output to the source driver 102.

The display modes can be roughly divided into an analog mode and a digital mode. In the analog mode, a video signal input to a pixel is an analog value. On the other hand, in the digital mode, a video signal input to a pixel is a digital value.

Figure 25:
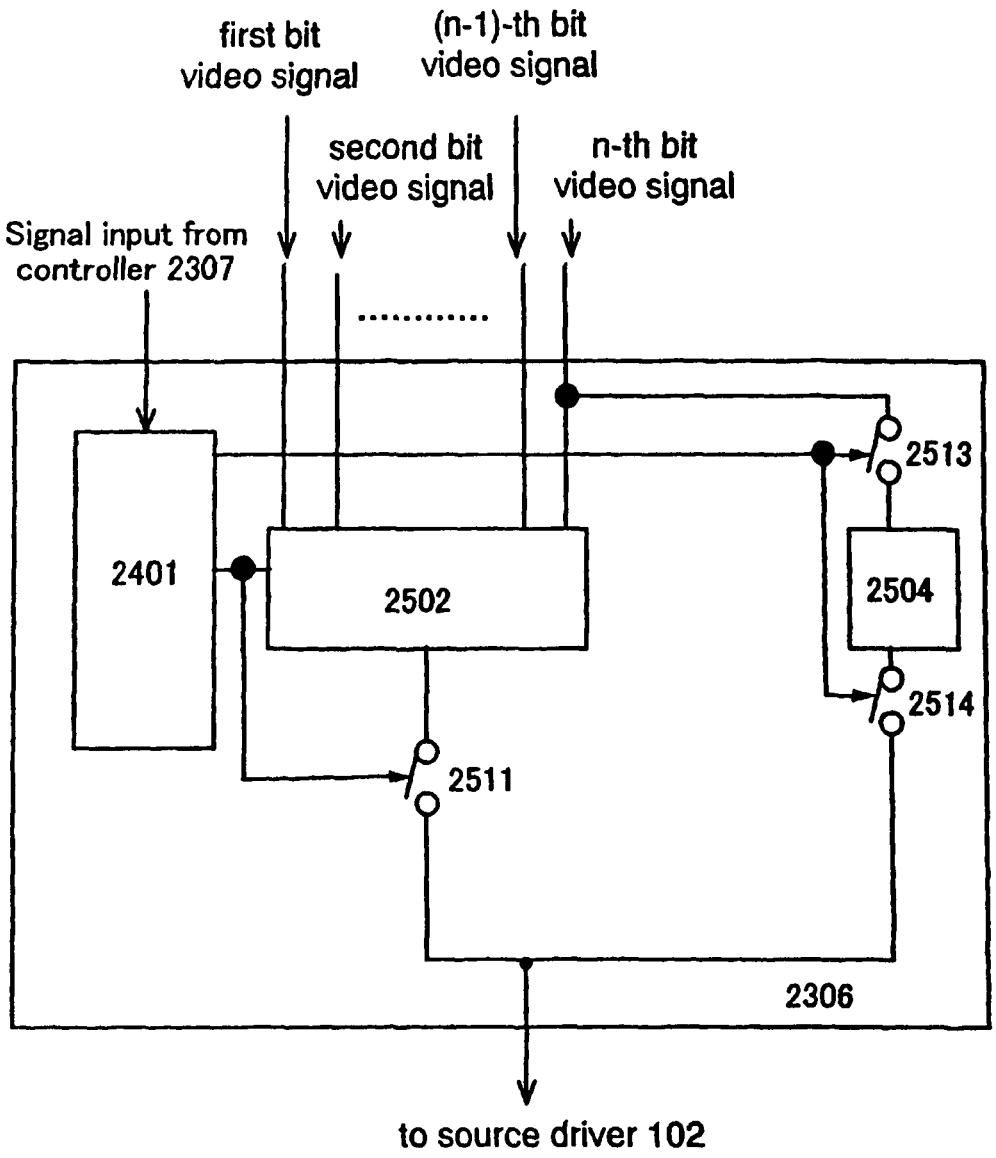
FIG. 25 is a diagram explaining a structure of a part of a display device of the present invention.

Next, details of the display mode-specific video signal generation circuit 2306 are shown in FIG. 25. Based on a signal input from the controller 2307, a display mode control circuit 2401 performs control so that display according to a display mode can be performed. For example, in the case of a digital mode, switches 2513 and 2514 are turned on, and only the most significant bit (MSB) of the video signal is output to the source driver 102. However, there is a case where a potential level does not meet. In that case, the potential level needs to be converted into a necessary level. Thus, when that is necessary, a level converter circuit 2504 is provided. On the other hand, in the case of an analog mode, the video signal is transmitted to a DA converter circuit (digital analog converter circuit) 2502 and an appropriate analog value is output to the source driver 102 through a switch 2511.

In FIG. 25, the case where the display mode is in an analog mode and a digital mode is shown; however, the invention is not limited thereto.

Figure 26:
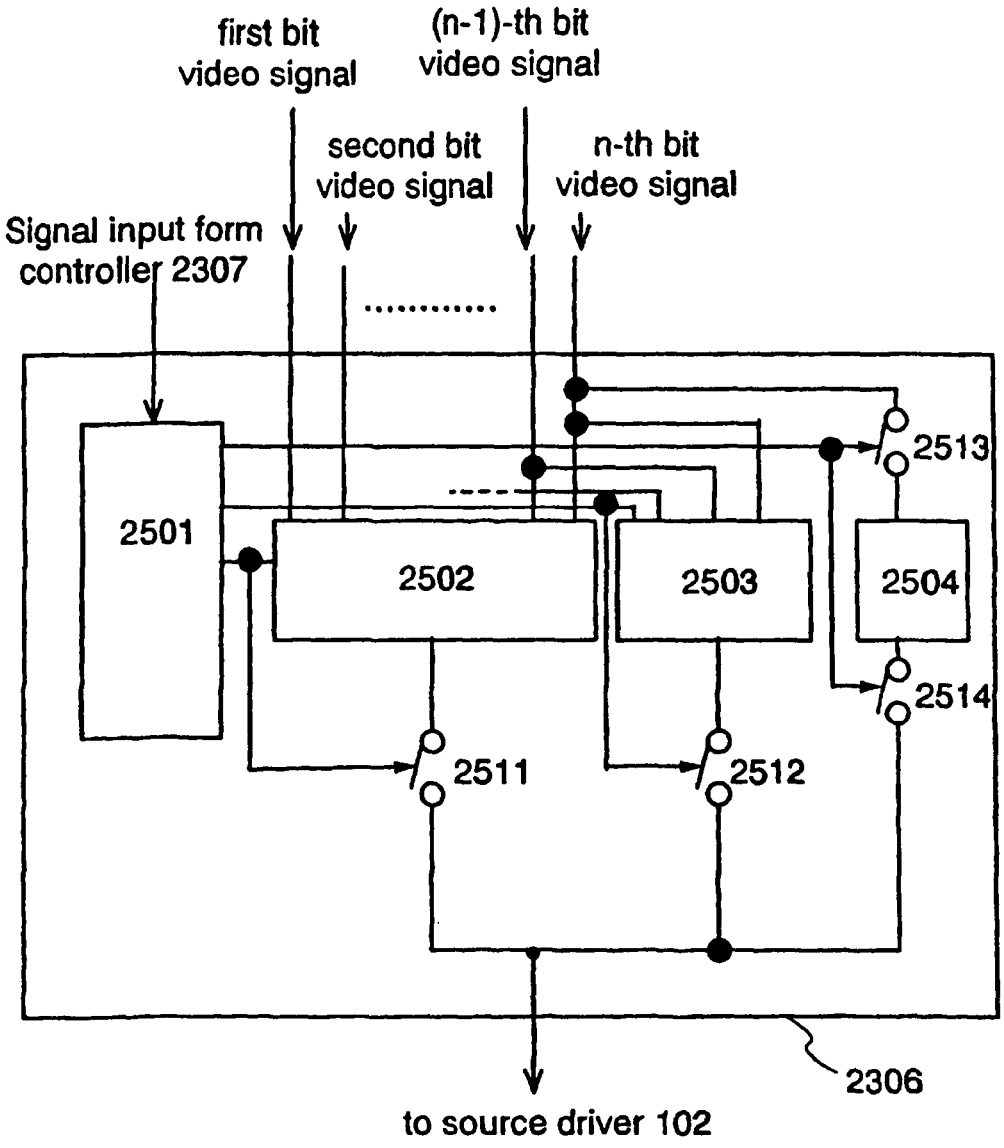
FIG. 26 is a diagram explaining a part of a structure of a display device of the present invention.

Then, details of the display mode-specific video signal generation circuit 2306 corresponding also to the case of a multi-valued mode is shown in FIG. 26. Based on a signal input from the controller 2307, a display mode control circuit 2501 performs control so that display according to a display mode can be performed. The cases of an analog mode and a digital mode are similar to FIG. 25. In the case of a multi-valued mode, only a higher bit of a video signal is input to a DA converter circuit 2503 when a switch 2512 is on state. A lower bit is not input. Thus, not smooth display but sampled display is performed.

Figure 27:
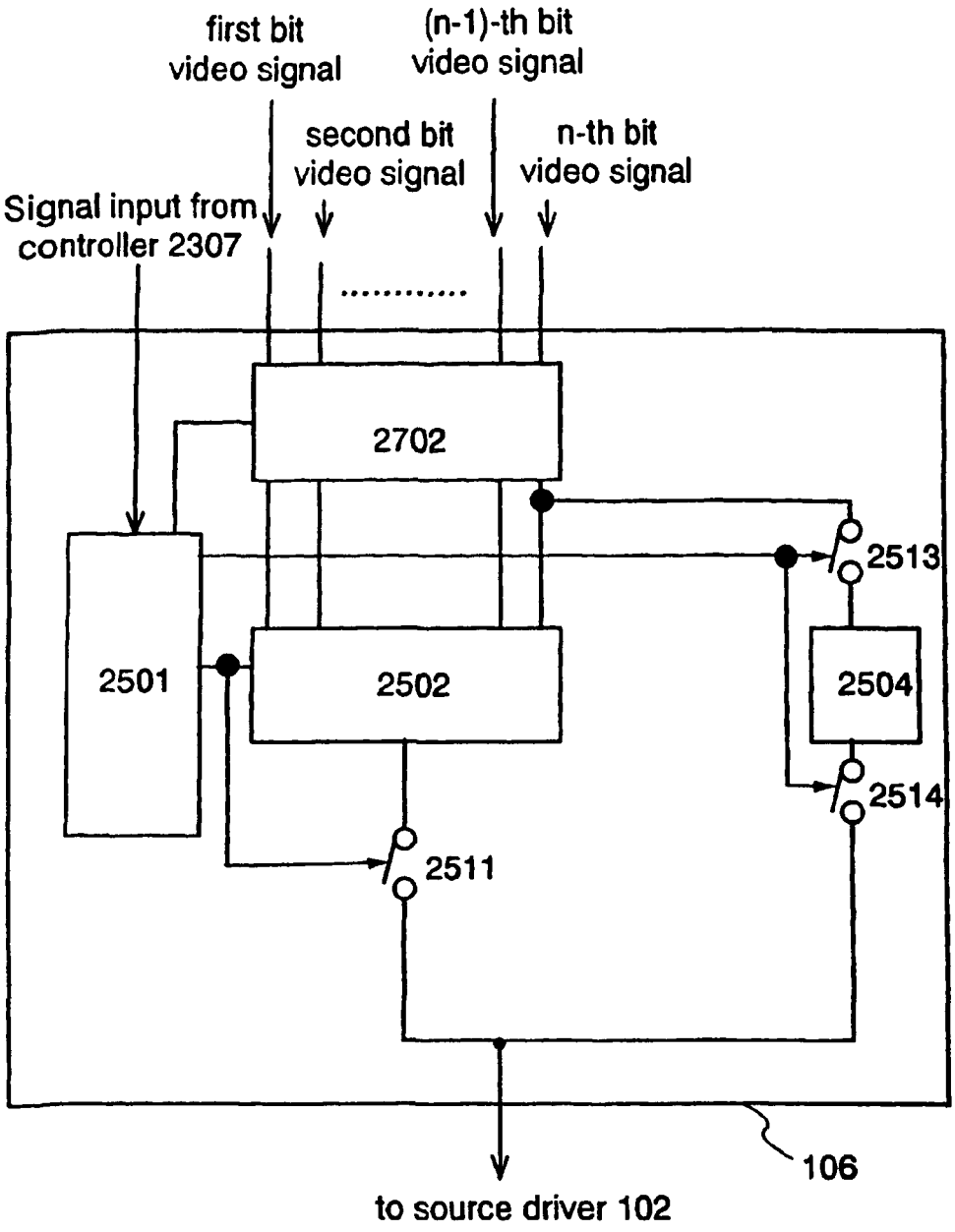
FIG. 27 is a diagram explaining a part of a structure of a display device of the present invention.

Note that in the multi-valued mode, sampling may be performed without using a lower bit; therefore, the invention is not limited to the configuration shown in FIG. 26. For example, a lower bit data removal circuit 2702 may be provided in an input portion of a DA converter circuit 2502 as shown in FIG. 27. As a result, the value of the lower bit is forced to 0 (or an L signal) in accordance with the signal of the display mode control circuit. Thus, not smooth display but sampled display is performed.

Figure 28:
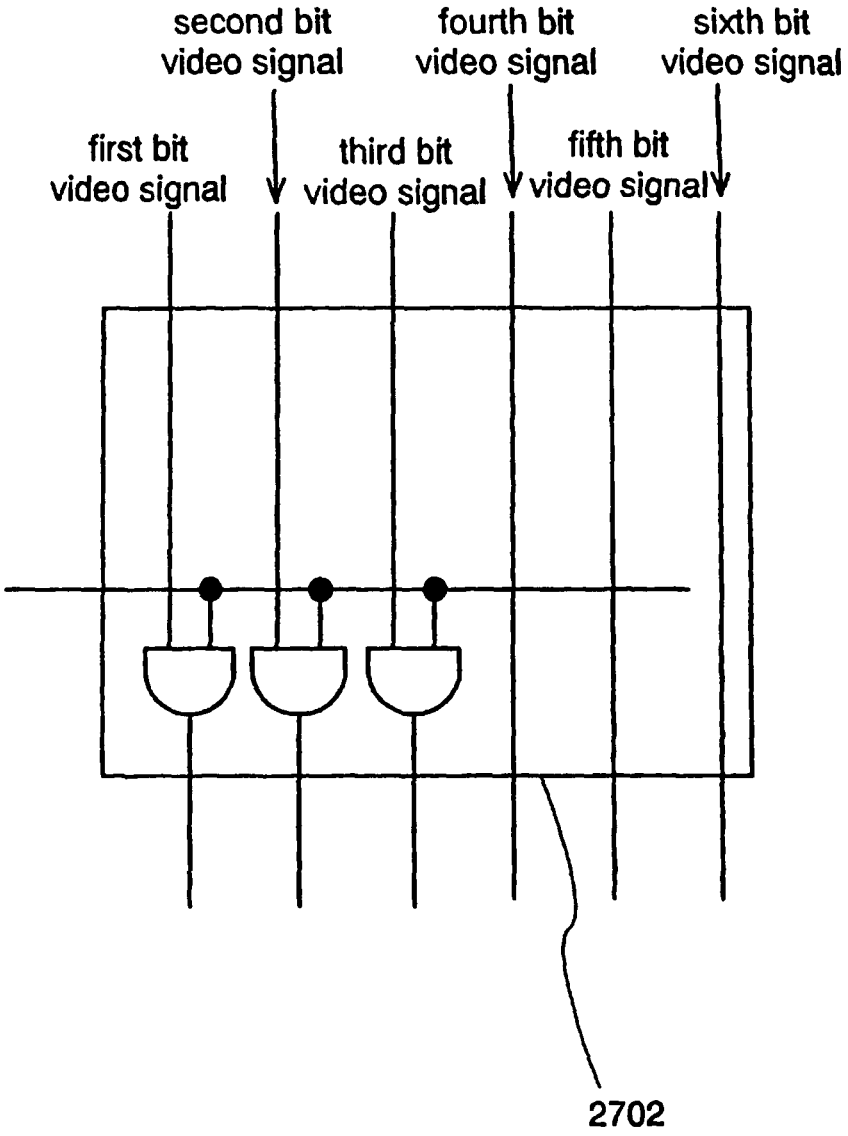
FIG. 28 is a diagram explaining a part of a structure of a display device of the present invention.

Then, an example of the lower bit data removal circuit 2702 is shown in FIG. 28. Data of lower 3 bits can be forced to 0 (or an L signal) using an AND circuit.

Note that the AND circuit is used in FIG. 28, but the invention is not limited thereto. A similar function can also be performed when an OR circuit, a NAND circuit, or a NOR circuit is used. In addition, in FIG. 28, a video signal of 6 bits is input and data of lower 3 bits thereof are forced to 0 (or an L signal), but the invention is not limited thereto. Modification may be made appropriately.

Figure 29:
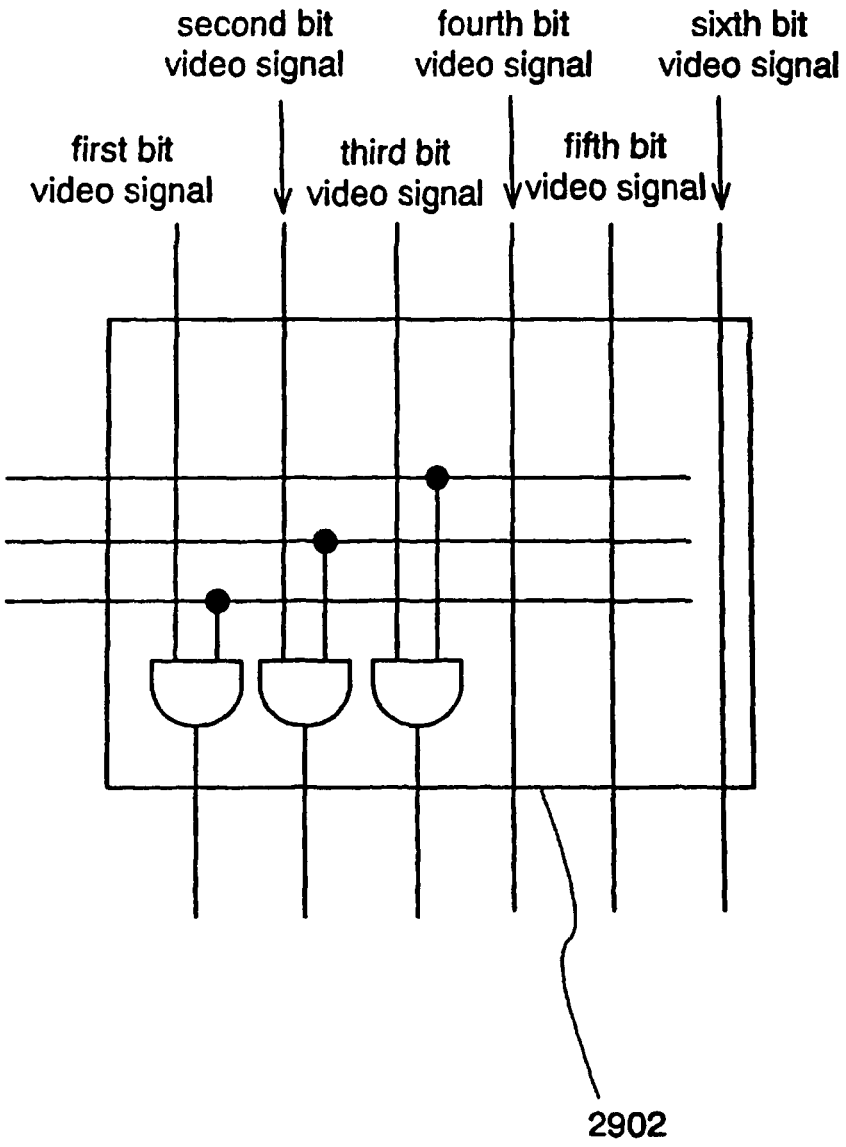
FIG. 29 is a diagram explaining a part of a structure of a display device of the present invention.

Thus, the number of bits of which data are to be forced to 0 (or an L signal) may be changed. A diagram of a circuit 2902 in that case is shown in FIG. 29. Since signals input to AND circuits are separated, the signals can be controlled individually.

Figure 30:
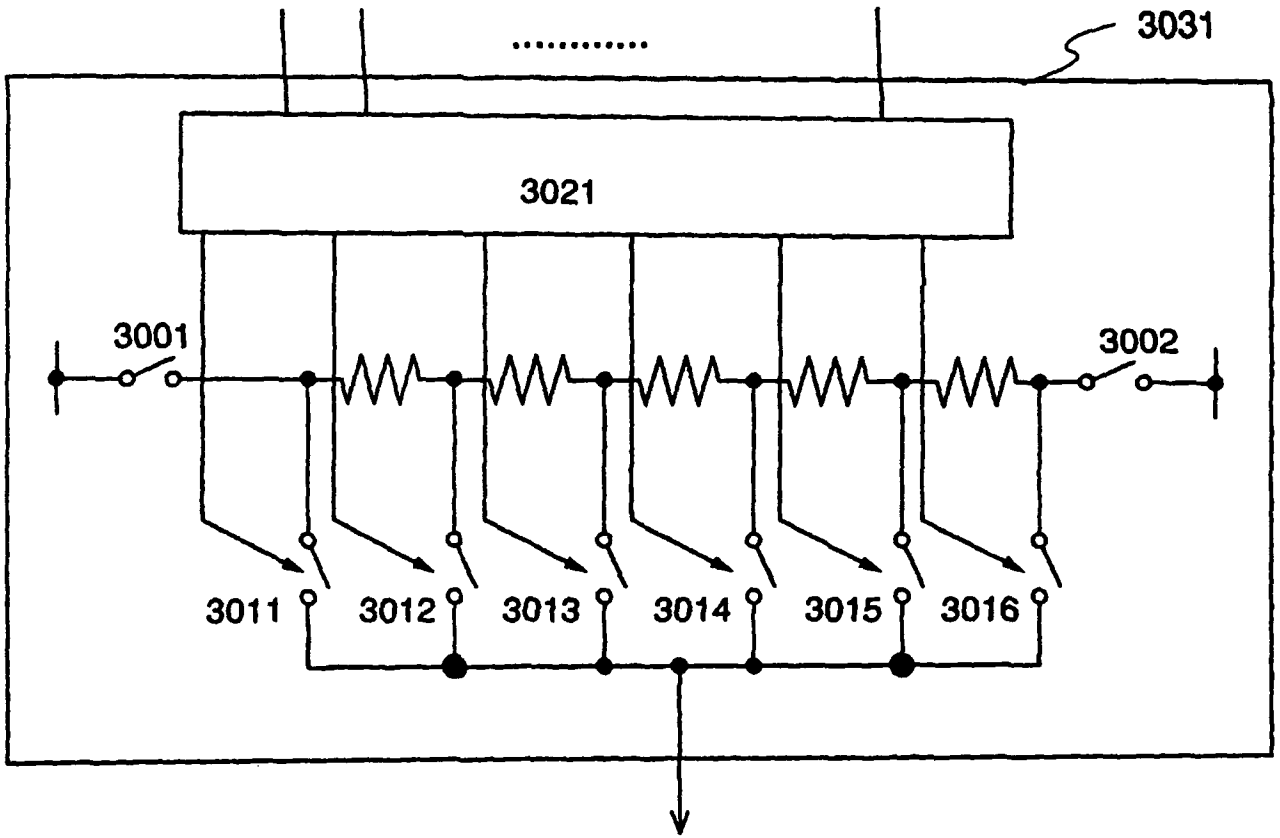
FIG. 30 is a diagram explaining a part of a structure of a display device of the present invention.

Next, details of the DA converter circuits shown in FIGS. 25 to 27 are shown in FIG. 30. A decoder circuit 3021 decodes the input digital signal, and accordingly, any of switches 3011 to 3016 is turned on to output an analog voltage. Then, switches 3001 and 3002 may be turned on only when the DA converter circuit is operated. As a result, a period during which a current flows to a resistor can be shortened, so that power consumption can be reduced.

When display is performed in a digital mode or a multi-valued mode as described above, thresholding is performed and sampling of image information is performed. Accordingly, even an image data including noise can be displayed with the noise removed when the image is actually displayed. In addition, the image can be seen clearly because a luminance change in one gray scale level is significant, so that contrast is enhanced.

The content described in this embodiment mode can be freely combined with the content described in Embodiment Mode 1.

(Embodiment Mode 3)

In this embodiment mode, the case of performing display using each display mode is described.

First, the case of performing display on an entire screen in the same display mode can be given. In other words, the case of performing display in an analog mode on the entire screen can be given. In this case, normal display can be performed. Since a smooth gray scale can be expressed, the case is suitable for displaying a picture and the like.

Next, the case of performing display in a digital mode on the entire screen can be given. In this case, contrast is enhanced and excellent visibility is obtained; therefore, it is suitable when characters are mainly displayed, such as for reading e-mail, reading an electronic book, and the like.

Subsequently, the case of performing display in a multi-valued mode on the entire screen can be given. In this case, contrast is enhanced and excellent visibility is obtained; therefore, it is suitable when displaying an illustration, an animation, a cartoon, and the like for which a gray scale is desired to be expressed, but not as precise as a picture and the like.

Next, the case where the entire screen is divided into a plurality of regions and each region performs display in a corresponding display mode, can be given. This is achieved due to the fact that a video signal in accordance with a display mode can be generated for each pixel in the display mode-specific video generation circuit 106 as FIG. 1 shows.

Figure 10:
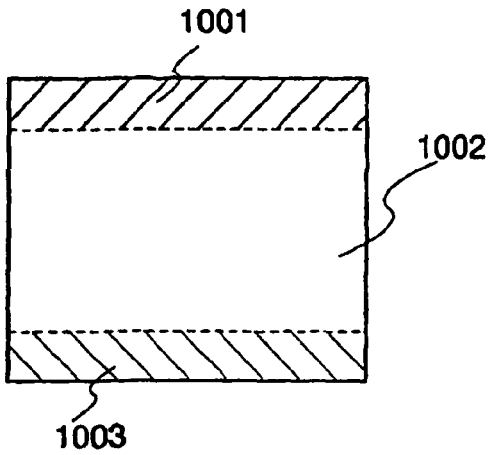
FIG. 10 is a diagram explaining a display condition of a display device of the present invention.

For example, a screen is divided into three regions as shown in FIG. 10. Then, an upper region 1001 performs display in a digital mode. For example, the upper region 1001 displays time, battery information, electric wave information, and the like to increase visibility. A middle region 1002 performs display in an analog mode as normal. The middle region 1002 can display an image such as a picture with a smooth gray scale. A lower region 1003 performs display in a multi-valued mode and displays a simple animation and the like.

Figure 11:
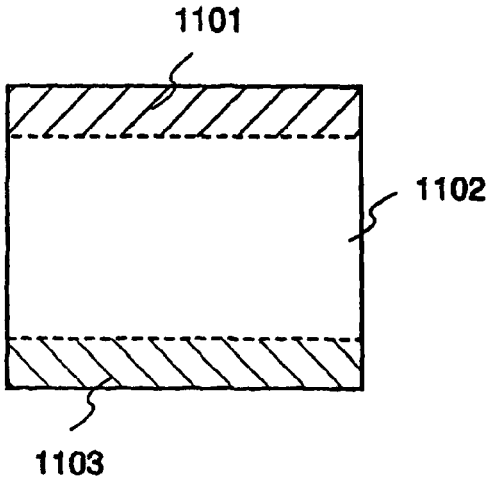
FIG. 11 is a diagram explaining a display condition of a display device of the present invention.

In FIG. 11, an upper region 1101 performs display in a multi-valued mode, and displays a simple animation and the like. A middle region 1102 performs display in a digital mode, and is suitable to read e-mail, an electronic book, and the like. In addition, a lower region 1103 also performs display in a multi-valued mode, and displays a simple animation and the like. This makes it possible to display a pretty, highly-attractive image rather than an unattractive image as in the case of performing display in a digital mode on the entire screen, since a simple colorful icon and the like can be displayed while being suitable for read e-mail, an electronic book, and the like by mainly performing display in a digital mode.

Figure 12:
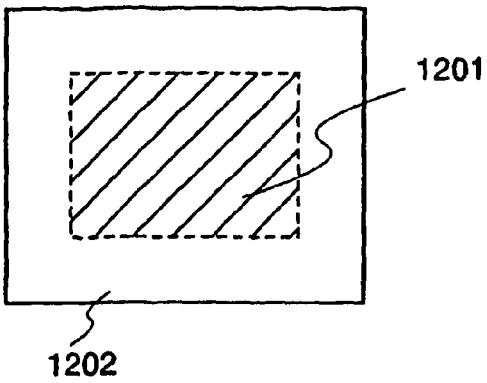
FIG. 12 is a diagram explaining a display condition of a display device of the present invention.

In FIG. 12, a central region 1201 performs display in an analog mode, and can clearly display an image such as a picture with a smooth gray scale. A peripheral region 1202 performs display in a digital mode, and can display an icon of time, battery information, electric wave information, or the like.

Figure 13:
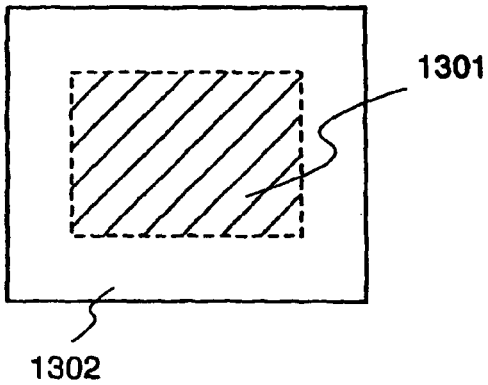
FIG. 13 is a diagram explaining a display condition of a display device of the present invention.

In FIG. 13, a peripheral region 1302 performs display in an analog mode, and can clearly display an image such as a picture with a smooth gray scale. A central region 1301 performs display in a multi-valued mode. In a portion performing display in a multi-valued mode, a smooth gray scale is converted into a stepwise gray scale. Therefore, in the case of displaying a human face in a multi-valued mode, the human face looks like a facial illustration or a cartoon. This function can be utilized to perform display like a simple photo sticker.

Note that the number, position, and shape of portions of a screen to be divided are not limited to those described above. In addition, which region and which display mode a display is performed in is not limited to those described above.

Note that this embodiment mode describes Embodiment Modes 1 and 2 in detail. Therefore, the content described in this embodiment mode can be freely combined with the content described in Embodiment Modes 1 and 2.

(Embodiment Mode 4)

In this embodiment mode, a method for driving a pixel in an analog mode is described.

Figure 16A:
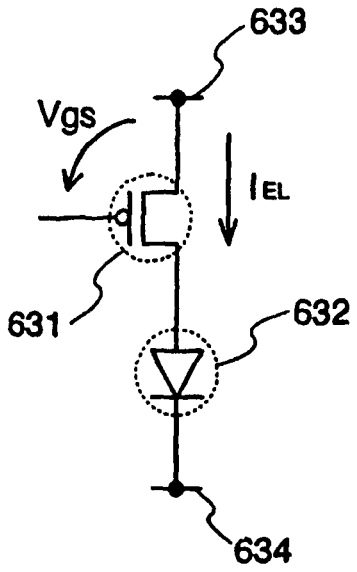
FIG. 16A is a diagram explaining a part of a structure of a display device of the present invention.
Figure 16B:
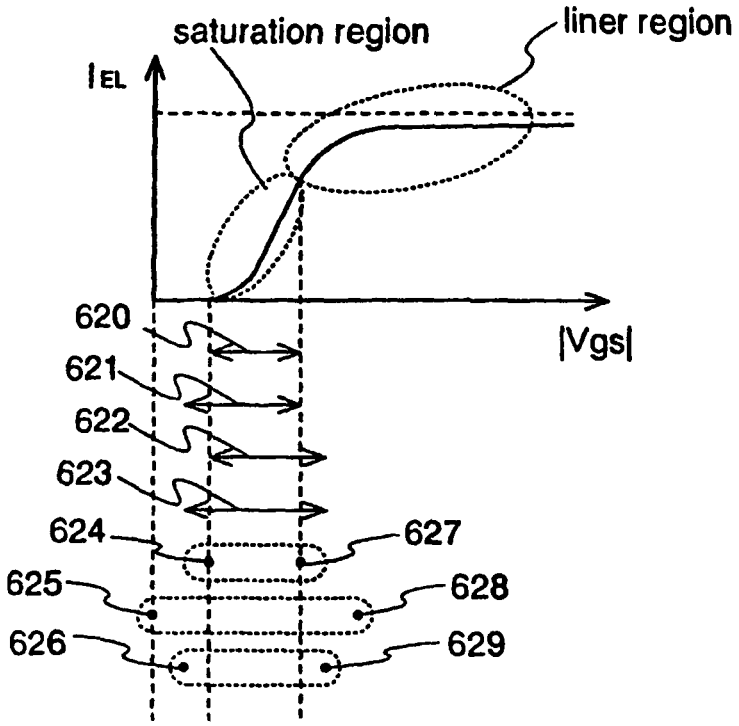
FIG. 16B is a graph explaining a driving method thereof.

FIGS. 16A and 16B show the relationship between a voltage and a current applied to a driver transistor and a light emitting element. FIG. 16A shows a circuit of a driver transistor 631 and a light emitting element 632. The driver transistor 631 and the light emitting element 632 are connected serially between a wire 633 and a wire 634. Since the wire 633 has a higher potential than that of the wire 634, a current flows to the light emitting element 632 from the driver transistor 631.

The driver transistor 406 in FIG. 15 corresponds to the driver transistor 631 in FIG. 16A, and the light emitting element 407 in FIG. 15 corresponds to the light emitting element 632 in FIG. 16A.

FIG. 16B shows the relationship between a gate-source voltage (or the absolute value thereof) of the driver transistor 631 and a current flowing to the driver transistor 631 and the light emitting element 632. As the gate-source voltage (or the absolute value thereof) is increased, a current value is also accordingly increased. This is because the driver transistor 631 operates in a saturation region. In a saturation region, a current value increases in proportion to the square of a gate-source voltage of a transistor. As the gate-source voltage (or the absolute value thereof) is further increased, a voltage applied to the light emitting element 632 is increased. Accordingly, a drain-source voltage is decreased, and the driver transistor 631 operates in a linear region. As the drain-source voltage is decreased, the rate of increase in the current value is also decreased. Then, a current equal to or more than a certain current value does not flow.

In an analog mode, a gray scale is expressed using an analog gray scale method. Thus, by changing the gate-source voltage (or the absolute value thereof) of the driver transistor 631 in an analog manner, the driver transistor 631 is preferably operated in such a state that the current flowing to the driver transistor 631 and the light emitting element 632 also changes in an analog manner. Therefore, the gate-source voltage (or the absolute value thereof) of the driver transistor 631 is preferably changed from a threshold voltage to a gate-source voltage at which the driver transistor 631 operates in a saturation region. Note that the upper limit of change is not limited to within a saturation region, and the gate-source voltage may be changed to a linear region. In other words, the gate-source voltage (or the absolute value thereof) of the driver transistor 631 may be in a region where a current value $I_{EL}$ changes with respect to the gate-source voltage (or the absolute value thereof). In addition, the lower limit of change may be a gate-source voltage (or the absolute value thereof) at which the driver transistor 631 is turned off.

For example, as in a voltage range 620, the gate-source voltage (or the absolute value thereof) of the driver transistor 631 may be controlled in such a state that the transistor operates in a saturation region from a state that almost no current flows. The state in which almost no current flows corresponds to the case where the gate-source voltage of the driver transistor 631 is approximately equal to the threshold voltage of the driver transistor 631.

Alternatively, as in a voltage region 621, the gate-source voltage (or the absolute value thereof) is increased and controlled from a state in which the gate-source voltage (or the absolute value thereof) of the driver transistor 631 is certainly lower than the threshold voltage of the driver transistor 631, and the gate-source voltage (or the absolute value thereof) of the driver transistor 631 may be controlled in such a state that the driver transistor 631 operates in a saturation region. By making the gate-source voltage of the driver transistor 631 in a black state certainly lower than the threshold voltage of the driver transistor 631, a black state can be assured. For example, if the current characteristic of the driver transistor 631 varies, the threshold voltage also varies. Thus, even when one pixel is in a black state, another pixel may slightly emit light. As a result, a decrease in contrast is caused. Thus, in order to prevent that, it is preferable to operate the driver transistor 631 in such a voltage range as 621.

Note that the driver transistor 631 is operated in a saturation region in the voltage range 620 and the voltage range 62l even if the gate-source voltage (or the absolute value thereof) is increased in the above-mentioned example. However, the invention is not limited thereto. As in a voltage range 622 and a voltage range 623, the driver transistor 631 may be operated not only in a saturation region but also in a linear region. By changing the gate-source voltage (or the absolute value thereof) of the driver transistor 631 in an analog manner, the driver transistor 631 may be operated also in a linear region as long as it is within such a range that a current flowing to the driver transistor 631 and the light emitting element 632 also changes in an analog manner.

Note that in the case where the driver transistor 631 is operated in a saturation region, a certain amount of current can be supplied to the light emitting element 632 even when the light emitting element is deteriorated. In addition, in the case of a linear region, the driver transistor can be driven without being affected by characteristic variation of the transistor.

Subsequently, the case of performing optimization depending on the color light emitted from of the light emitting element 632 is described. The luminance and necessary current value of the light emitting element 632 vary depending on color. Thus, a color balance needs to be adjusted. In order for that to be done, the gate-source voltage (or the absolute value thereof) of the driver transistor 631 is desirably changed depending on color. Alternatively, the current supply capacity of the driver transistor 631 (for example, a wide of a channel region of a transistor or the like) is desirably changed depending on color. Alternatively, the light emitting area of the light emitting element 632 is desirably changed depending on color. Further alternatively, some of these are desirably combined. This enables to adjust the color balance.

Note that the potential of the wire 633 can be changed depending on color. However, there is the disadvantage that the voltage at which the driver transistor 631 is turned off is also changed depending on color. Therefore, the potential of the wire 633 may be equivalent in all colors.

Note that the case where the driver transistor 631 is a p-channel transistor is described, but the invention is not limited thereto. It is easy for one skilled in the art to reverse the direction of current flow by using an n-channel transistor. In addition, it is also easy for one skilled in the art to reverse the direction of current flow either in the case of a p-channel transistor or in the case of an n-channel transistor. In that case, the amount of gate-source voltage is affected by the voltage-current characteristic of the light emitting element 632.

Note that the case of an analog mode is described in this embodiment mode, but this embodiment mode can be similarly applied to the case of a multi-valued mode.

Note that this embodiment mode describes the pixel of Embodiment Modes 1 to 3 in detail. Therefore, the content described in this embodiment mode can be freely combined with the content described in Embodiment Modes 1 to 3.

(Embodiment Mode 5)

In this embodiment mode, a method for driving a pixel in a digital mode is described.

The relationship between the gate-source voltage (or the absolute value thereof) of the driver transistor 631 and a current flowing to the driver transistor 631 and the light emitting element 632, shown in FIG. 16B, is referred to. In a digital mode, control is performed in binary like on and off, or H and L. In other words, Whether or not a current flows to the light emitting element 632 is controlled. First, the case where current does not flow is considered. In that case, the gate-source voltage (or the absolute value thereof) of the driver transistor 631 may be 0 V or more as indicated by a voltage 624, a voltage 625, and a voltage 626 and equal to or lower than the threshold voltage of the driver transistor 631.

Next, the case where current flows is considered. In that case, the driver transistor 631 may be operated in a saturation region, a linear region, or a region in a linear region where voltage is further increased and a current value is not increased, or the like with the gate-source voltage (or the absolute value thereof) of a voltage 627, a voltage 628, and a voltage 629. Note that the voltage 627 is located at the boundary of a linear region and a saturation region in the diagram, but it is acceptable as long as it is within the saturation region. Thus, there is no particular limitation on the gate-source voltage as long as it can cause a current to flow to the light emitting element 632 from the driver transistor 631.

For example, operation in a saturation region has the advantage that the value of a current flowing through the light emitting element 632 does not vary even when the voltage-current characteristic thereof is deteriorated. Therefore, the current value is hardly affected by burn-in. However, when the current characteristics of the driver transistors 631 vary, the current flowing therethrough also varies. Thus, uneven display may be caused.

On the other hand, if the driver transistor 631 is operated in a linear region, the value of a current flowing through the driver transistor 631 is hardly affected even when the current characteristic of the driver transistor 631 varies. Therefore, uneven display is hardly caused. In addition, power consumption can be reduced because the gate-source voltage (or the absolute value thereof) of the driver transistor 631 does not become too high and the voltage between the wire 633 and the wire 634 does not need to be high.

Furthermore, when the gate-source voltage (or the absolute value thereof) of the driver transistor 631 is high, the value of a current flowing through the driver transistor 631 is hardly affected even if the current characteristic thereof varies. However, when the voltage-current characteristic of the light emitting element 632 is deteriorated, the value of a current flowing therethrough may vary. Therefore, the current value is easily affected by burn-in.

As described above, when the driver transistor 631 is operated in a saturation region, the value of a current flowing therethrough does not vary even if the characteristics of the light emitting element 632 vary. Therefore, in that case, it can be assumed that the driver transistor 631 operates as a current source. Thus, such drive is referred to as constant current drive.

When the driver transistor 631 is operated in a linear region, the current value does not vary even if the current characteristic of the driver transistor 631 varies. Therefore, in that case, it can be assumed that the driver transistor 631 operates as a switch. Accordingly, the voltage of the wire 633 can be considered to be applied to the light emitting element 632 without any change. Thus, such drive is referred to be constant voltage drive.

In a digital mode, either constant voltage drive or constant current drive may be employed. However, constant voltage drive is preferable since the constant voltage drive is not affected by variations in transistors and can reduce power consumption.

Next, the case of performing optimization depending on the color of emission form the light emitting element 632 is described. The case of constant current drive is similar to an analog mode.

In the case of constant voltage drive, even if the gate-source voltage (or the absolute value thereof) of the driver transistor 631 and the current supply capacity of the driver transistor 631 (for example, a transistor width or the like) are changed depending on color, the value of a current flowing therethrough does not vary so much. This is because the driver transistor operates 631 as a switch.

Therefore, the light emitting areas of the light emitting elements 632 are desirably differentiated depending on color. Alternatively, the potentials of the wire 633 can be differentiated depending on color. Alternatively, these are desirably combined. This enables to adjust the color balance.

Note that in the case of performing color display in a digital mode, display is performed in binary in each of RGB; therefore, display can be performed in eight colors in total.

Note that this embodiment mode describes the pixel and the like of Embodiment Modes 1 to 4 in detail. Therefore, the content described in this embodiment mode can be freely combined with the content described in Embodiment Modes 1 to 4.

(Embodiment Mode 6)

Figure 17:
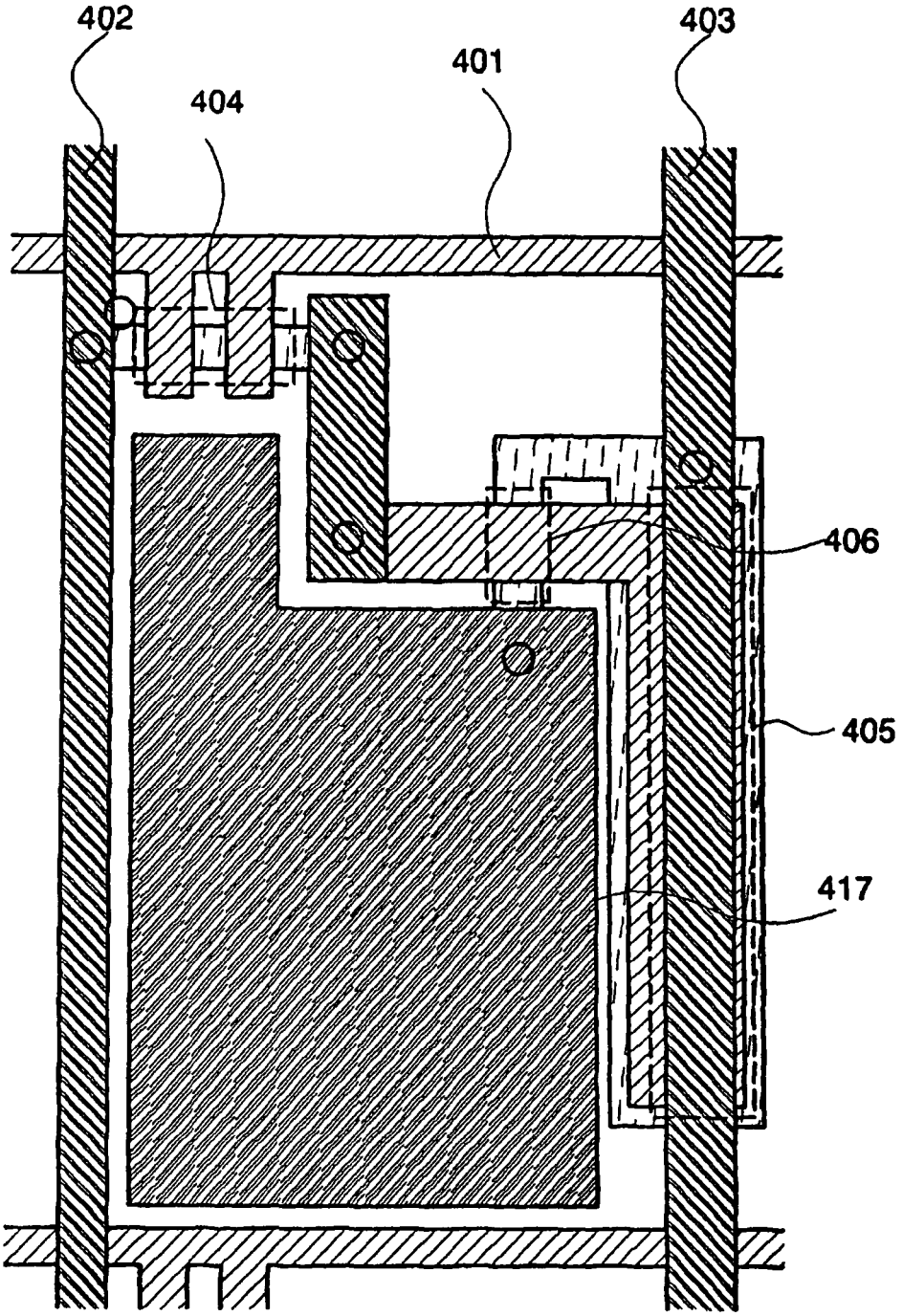
FIG. 17 is a diagram explaining a structure of a pixel in a display device of the present invention.

Next, description is made on the layout of a pixel in the display device of the present invention. As an example, FIG. 17 is a layout diagram of the circuit diagram shown in FIG. 15. Note that the circuit diagram and the layout diagram are not limited to FIGS. 15 and 17.

Electrodes of the selection transistor 404, the driver transistor 406, and the light emitting element 407 are arranged. A source and a drain of the selection transistor 404 are connected to the source signal line 402 and a gate of the driver transistor 406, respectively. A gate of the selection transistor 404 is connected to the gate signal line 401. A source and a drain of the driver transistor 406 are connected to the power supply line 403 and an electrode 417 of the light emitting element 407, respectively. The storage capacitor 405 is connected between the gate of the driver transistor 406 and the power supply line 403.

The source signal line 402 and the power supply line 403 are formed with a second wire, and the gate signal line 401 is formed with a first wire.

In the case of a top gate structure, a substrate, a semiconductor layer, a gate insulating film, the first wire, an interlayer insulating film, and the second wire are formed in this order. In the case of a bottom gate structure, a substrate, the first wire, a gate insulating film, a semiconductor layer, an interlayer insulating film, and the second wire are formed in this order.

Note that the content described in this embodiment mode can be freely combined with the content described in Embodiment Modes 1 to 5.

(Embodiment Mode 7)

In this embodiment mode, description is made on hardware for controlling the display devices described in Embodiment Modes 1 to 6.

Figure 18:
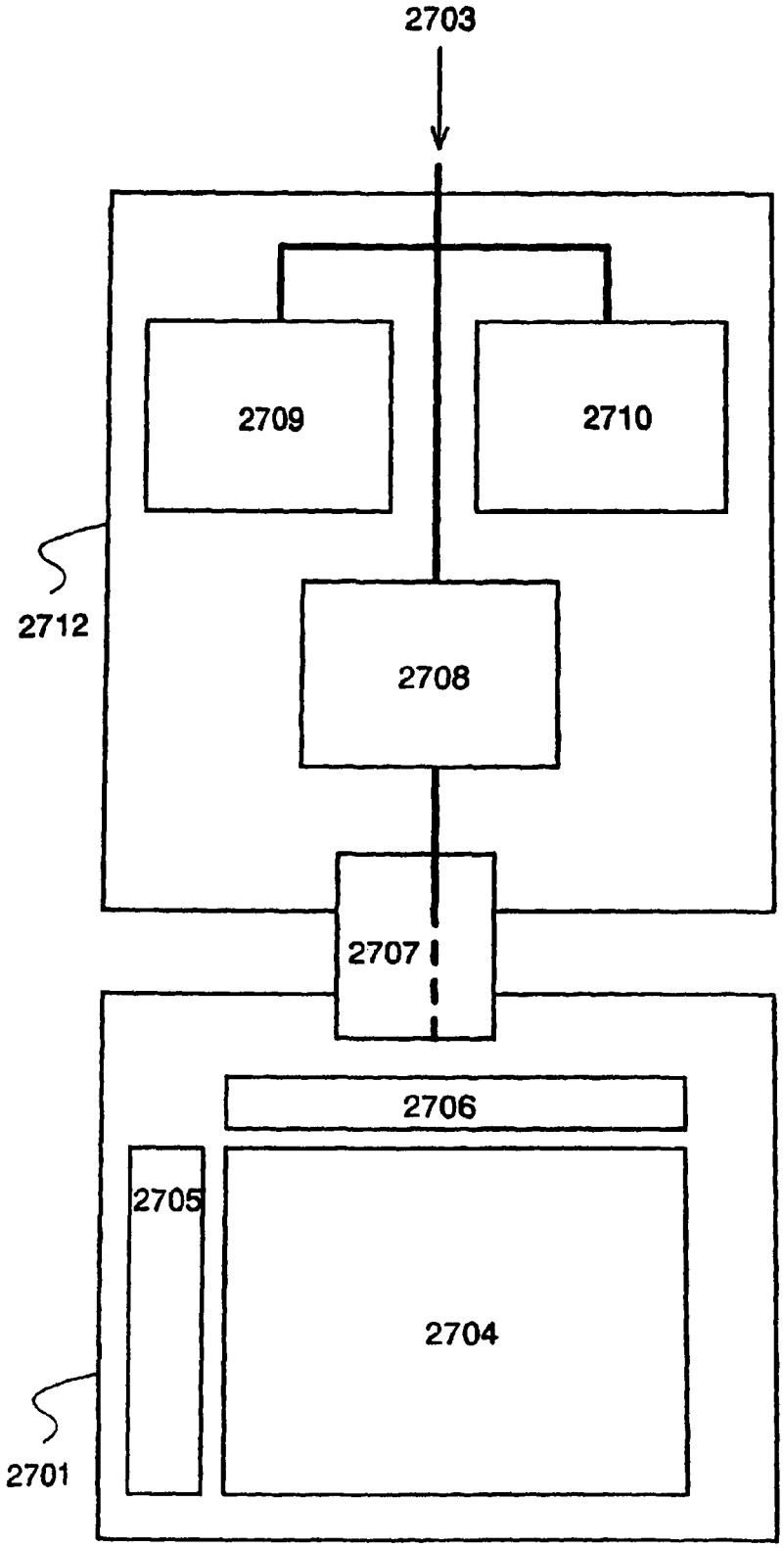
FIG. 18 is a diagram explaining a structure of a display device of the present invention.

FIG. 18 is a rough constitution diagram. A pixel array 2704 is arranged over a substrate 2701. In addition, a source driver 2706 and a gate driver 2705 are arranged in many cases. Besides, a power supply circuit, a precharge circuit, a timing generation circuit, and the like may be arranged. There is also a case where the source driver 2706 and the gate driver 2705 are not arranged. In that case, a circuit which is not provided over the substrate 2701 is formed on an IC in many cases. The IC is mounted on the substrate 2701 by using a COG (Chip On Glass) method in many cases. Alternatively, the IC may be mounted on a connecting substrate 2707 which connects a peripheral circuit substrate 2712 and the substrate 2701.

A signal 2703 is input to the peripheral circuit substrate 2712, and a controller 2708 performs control to store the signal in a memory 2709, a memory 2710, or the like. In the case where the signal 2703 is an analog signal, the signal is stored in the memory 2709, the memory 2710, or the like in many cases after analog-digital conversion is performed. Then, the controller 2708 outputs a signal to the substrate 2701 by using the signal stored in the memory 2709, the memory 2710, or the like.

In order to realize the driving methods described in Embodiment Modes 1 to 5, the controller 2708 controls various pulse signals or the like and outputs a signal to the substrate 2701.

Note that the content described in this embodiment mode can be complemented in free combination with the content described in Embodiment Modes 1 to 6.

(Embodiment Mode 8)

Figure 19:
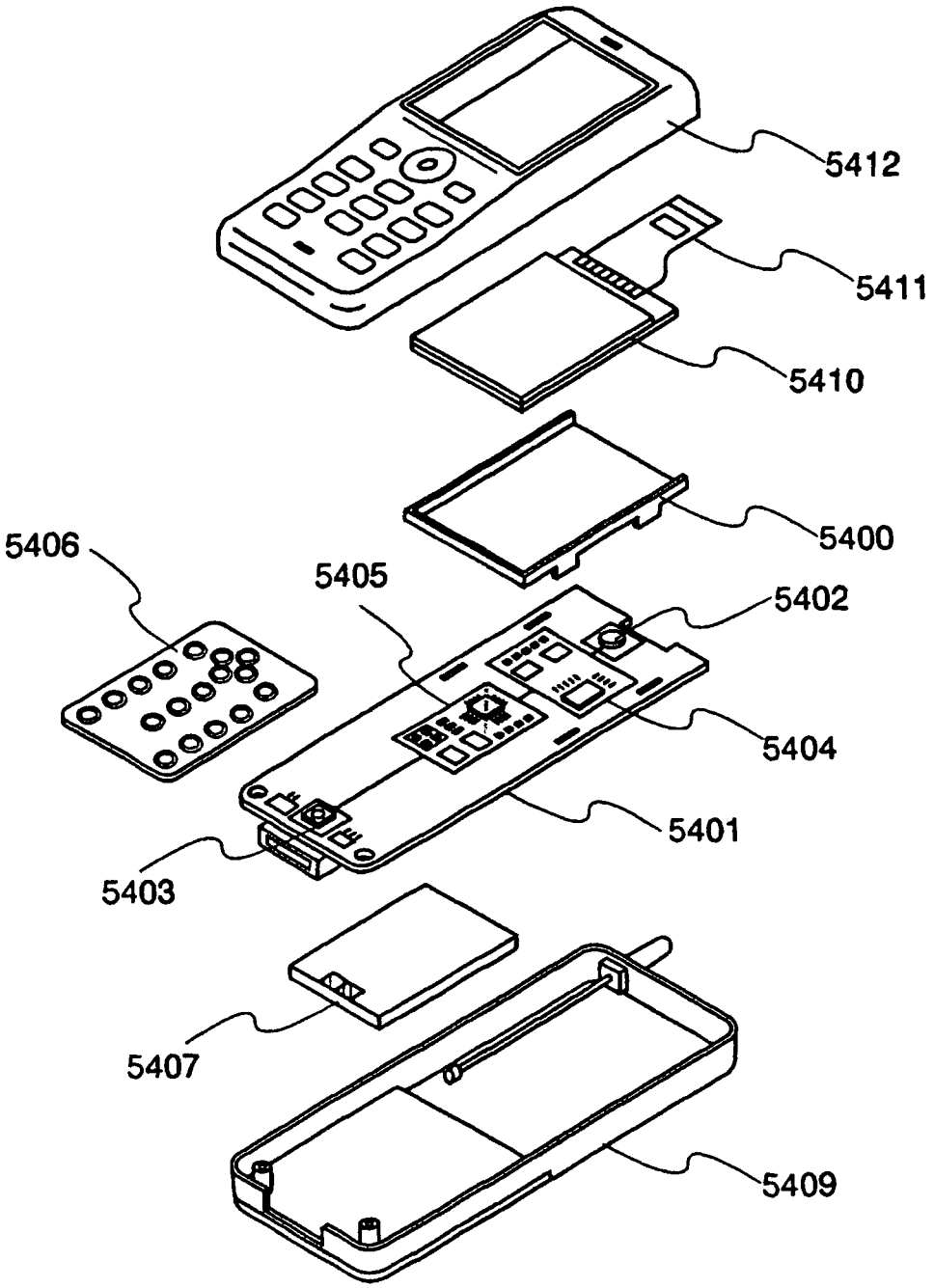
FIG. 19 is a diagram explaining an electronic device to which the present invention is applied.

An example of the structure of a mobile phone which has the display device of the invention, which is a display device using the driving method of the invention in a display portion is explained with reference to FIG. 19.

A display panel 5410 is incorporated in a housing 5400 so as to be detachable. The shape and size of the housing 5400 can be appropriately changed in accordance with the size of the display panel 5410. The housing 5400 to which the display panel 5410 is fixed is fitted in a printed circuit board 5401 and assembled as a module.

The display panel 5410 is connected to the printed circuit board 5401 through an FPC 5411. The printed circuit board 5401 is provided with a speaker 5402, a microphone 5403, a transmitting and receiving circuit 5404, and a signal processing circuit 5405 including a CPU, a controller, and the like. Such a module, an input means 5406, and a buttery 5407 are combined and stored using a chassis 5409 and a chassis 5412. Note that a pixel portion of the display panel 5410 is arranged so as to be seen from a window formed in the chassis 5412.

In the display panel 5410, the pixel portion and part of peripheral driver circuits (a driver circuit having a low operation frequency among a plurality of driver circuits) may be formed using TFTs in an integrated manner over a substrate, and another part of the peripheral driver circuits (a driver circuit having a high operation frequency among the plurality of driver circuits) may be formed on an IC chip. The IC chip may be mounted on the display panel 5410 by using a COG (Chip On Glass) method. The IC chip may alternatively be connected to a glass substrate using a TAB (Tape Automated Bonding) method or a printed circuit board. Note that FIG. 20A shows an example of constitution of a display panel where part of peripheral driver circuits is integrated with a pixel portion over a substrate and an IC chip on which the another part of peripheral driver circuits is formed is mounted by a COG method or the like.

Figure 20A:
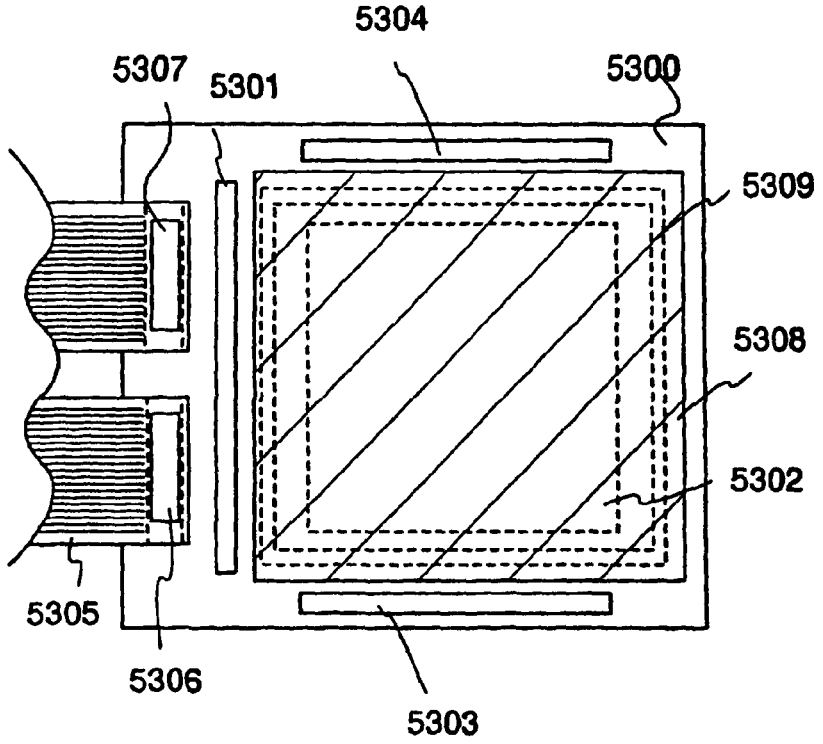
FIGS. 20A and 20B are diagrams explaining structures of display devices of the present invention.

The display panel in FIG. 20A may have a structure in which a pixel portion 5302 and its peripheral driver circuits (a first scan line driver circuit 5303 and a second scan line driver circuit 5304) are integrated over a substrate 5300, and a signal line driver circuit 5301 is formed on an IC chip and mounted on the display panel by using a COG method or the like. Note that the pixel portion 5302 and the peripheral driver circuits integrated over the substrate are sealed by attaching a sealing substrate 5308 to the substrate 5300 with a sealant 5309. In addition, IC chips (semiconductor chips provided with a memory circuit, a buffer circuit, and the like) 5306 and 5307 may be mounted on a connection portion of an FPC 5305 and the display panel by using a COG (Chip On Glass) method or the like. Note that only the FPC is shown here; however, a printed wiring board (PWB) may be attached to this FPC.

As described above, only part of a signal line driver circuit which requires high speed operation is formed on an IC chip using a CMOS or the like to reduce power consumption. In addition, higher-speed operation and lower power consumption can be achieved by using a semiconductor chip of a silicon wafer or the like as the IC chip. Furthermore, cost reduction can be achieved by integrating the first scan line driver circuit 5303 and the second scan line driver circuit 5304 with the pixel portion 5302. In addition, a substrate area can be used efficiently by mounting an IC chip provided with a functional circuit (a memory or a buffer) on a connection portion of the FPC 5305 and the substrate 5300.

Figure 20B:
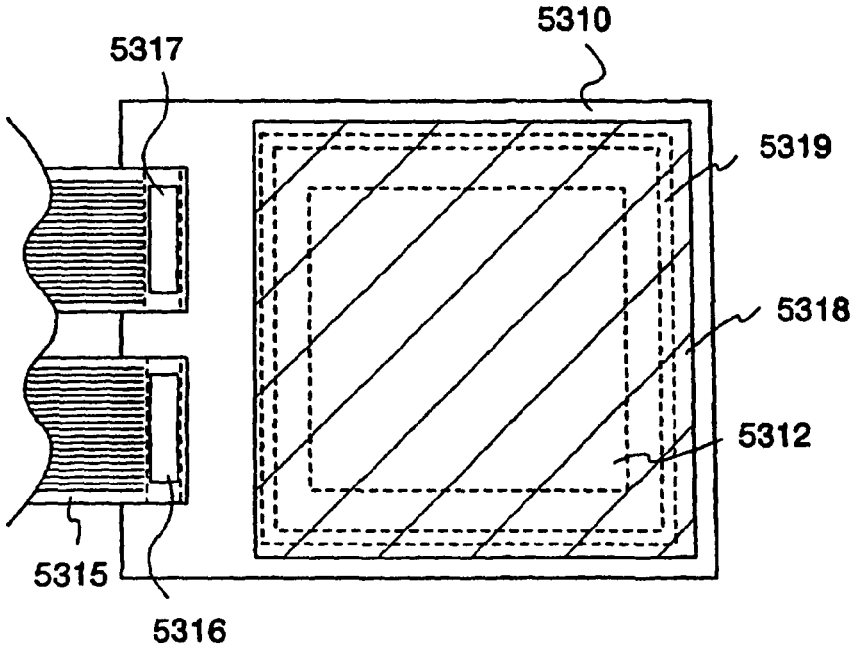

In order to further reduce power consumption, all of the peripheral driver circuits may be formed on an IC chip, and the IC chip may be mounted on the display panel by using a COG method or the like. For example, a pixel portion 5312 may be formed over a substrate 5310, and a signal line driver circuit, a first scan line driver circuit, and a second scan line driver circuit may be formed on IC chips, which may be mounted on a display panel by using a COG method or the like as shown in FIG. 20B. Note that an FPC 5315, an IC chip 5316, an IC chip 5317, a sealing substrate 5318, and a sealant 5319 in FIG. 20B correspond to the FPC 5305, the IC chip 5306, the IC chip 5307, the sealing substrate 5308, and the sealant 5309 in FIG. 20A, respectively.

By employing the above-described structure, power consumption of the display device can be reduced and operating time per charge of the mobile phone can be made longer. In addition, cost reduction of the mobile phone can be achieved.

In addition, by converting the impedance of a signal set to a scan line or a signal line by using a buffer, a write period for pixels of each row can be shortened. Accordingly, a high-definition display device can be provided.

By using the display device of the invention, it becomes possible to see a high-contrast clear image.

The structure described in this embodiment mode is an example of a mobile phone, and the display device of the invention can be applied not only to the mobile phone having the above-described structure but also to mobile phones having various kinds of structures.

(Embodiment Mode 9)

Figure 21:
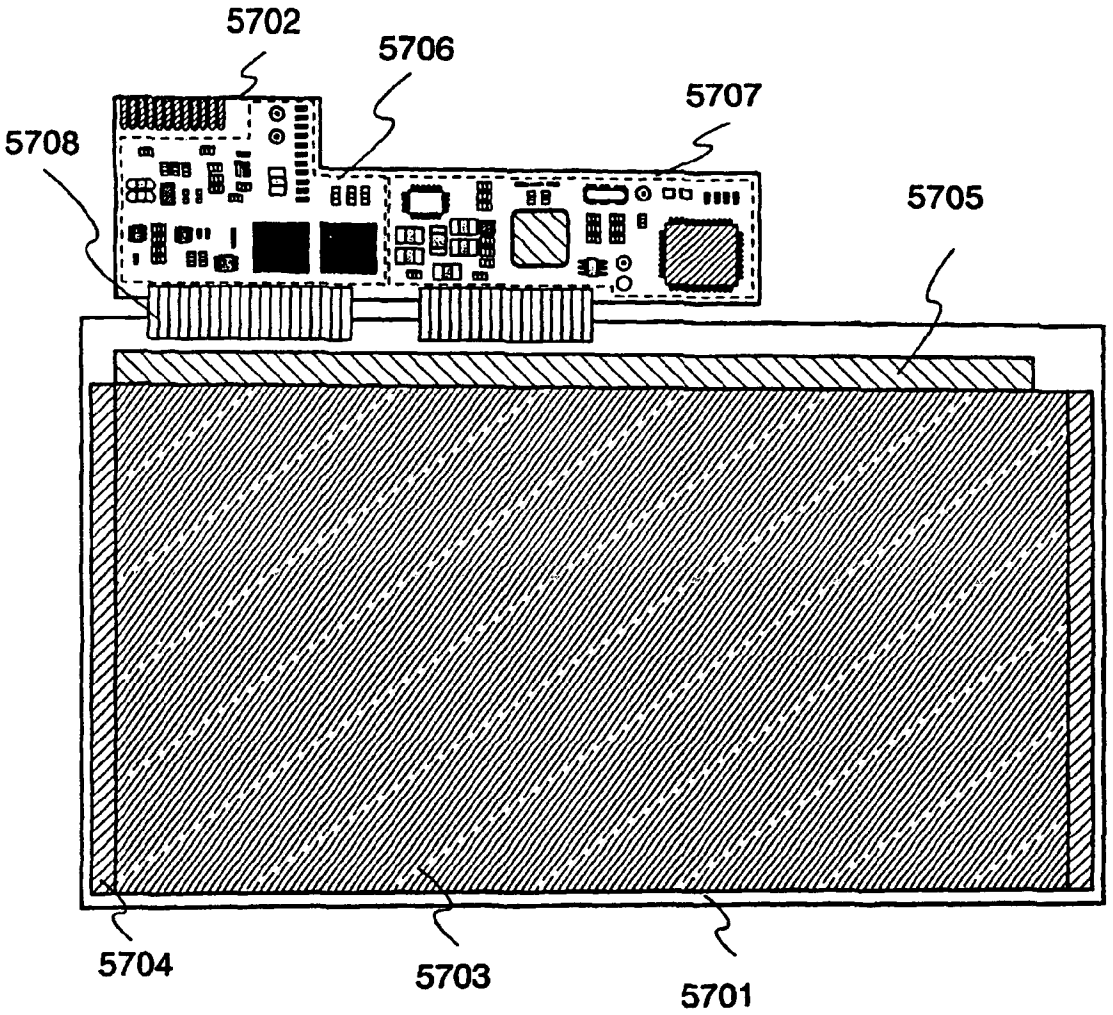
FIG. 21 is a diagram explaining a structure of a display device of the present invention.

FIG. 21 shows an EL module in which a display panel 5701 and a circuit board 5702 are combined. The display panel 5701 includes a pixel portion 5703, a scan line driver circuit 5704, and a signal line driver circuit 5705. Over the circuit board 5702, for example, a control circuit 5706, a signal dividing circuit 5707, and the like are formed. The display panel 5701 and the circuit board 5702 are connected to each other by a connection wiring 5708. As the connection wiring, an FPC or the like can be used.

The control circuit 5706 corresponds to the controller 2708, the memory 2709, the memory 2710, or the like in Embodiment Mode 7. Mainly in the control circuit 5706, the appearance order of subframes or the like is controlled.

In the display panel 5701, the pixel portion and part of peripheral driver circuits (a driver circuit having a low operation frequency among a plurality of driver circuits) may be formed using TFTs in an integrated manner over a substrate, and another part of the peripheral driver circuits (a driver circuit having a high operation frequency among the plurality of driver circuits) may be formed on an IC chip. The IC chip may be mounted on the display panel 5701 by using a COG (Chip On Glass) method or the like. The IC chip may alternatively be mounted on the display panel 5701 by using a TAB (Tape Automated Bonding) method or a printed circuit board. Note that an example of constitution of a display panel where part of peripheral driver circuits is integrated with a pixel portion over a substrate and an IC chip on which another part of the peripheral driver circuits is formed is mounted by using a COG method or the like, is shown in FIG. 20A. By using the above-described structure, power consumption of the display device can be reduced, and operating time per charge of a mobile phone can be made longer. In addition, cost reduction of a mobile phone can be achieved.

In addition, by converting the impedance of a signal set to a scan line or a signal line by using a buffer, a write period for pixels of each row can be shortened. Accordingly, a high-definition display device can be provided.

In order to further reduce power consumption, a pixel portion may be formed using TFTs over a glass substrate, and all signal line driver circuits may be formed on an IC chip, which may be mounted on a display panel by using a COG (Chip On Glass) method or the like.

Note that a pixel portion may be formed using TFTs over a substrate, and all peripheral driver circuits may be formed on an IC chip, which may be mounted on a display panel by using a COG (Chip On Glass) method. Note that an example of constitution where a pixel portion is formed over a substrate and an IC chip provided with a signal line driver circuit is mounted on the substrate by using a COG method or the like, is shown in FIG. 20B.

Figure 22:
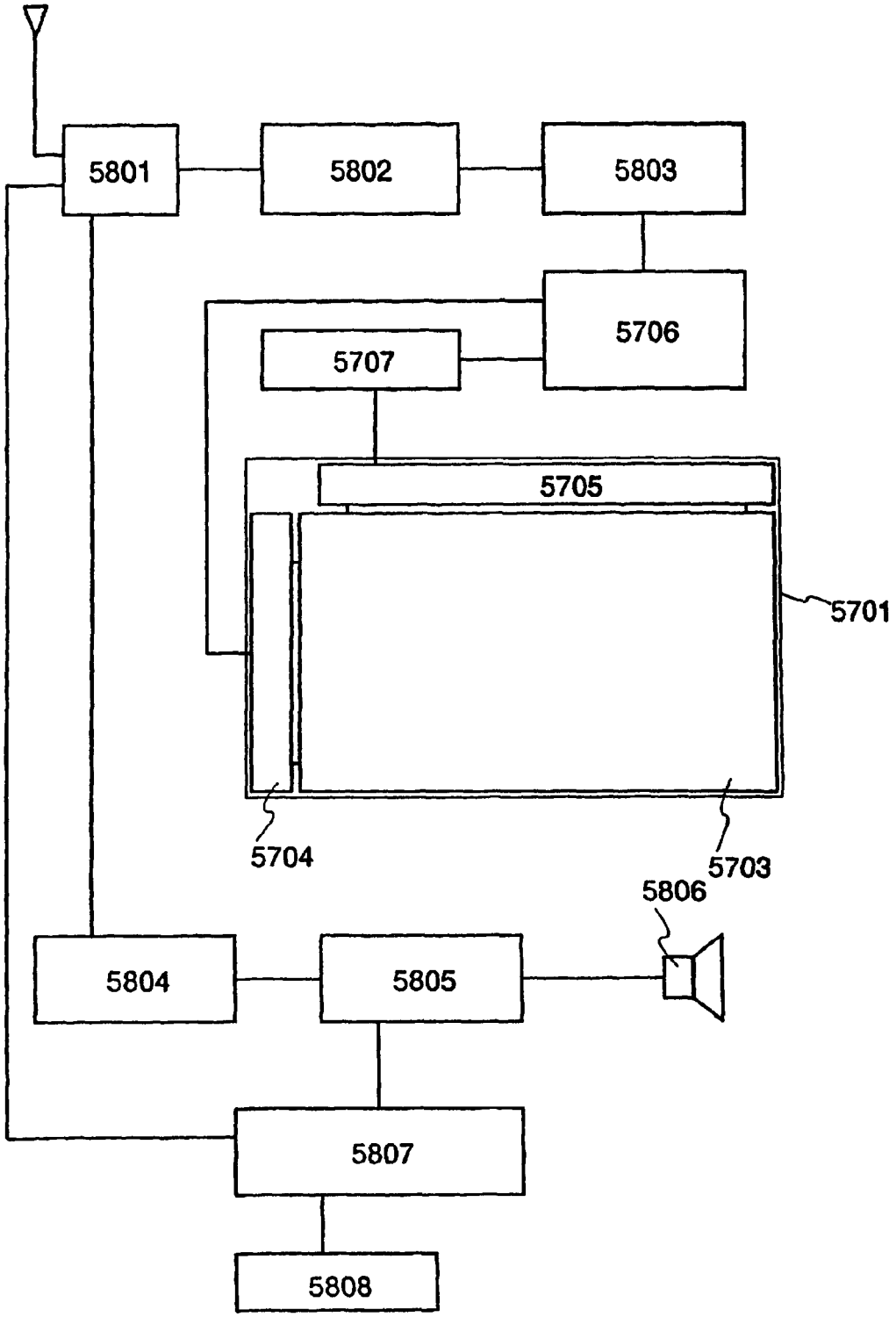
FIG. 22 is a diagram explaining a structure of a display device of the present invention.

An EL TV receiver can be completed with the above-described EL module. FIG. 22 is a block diagram showing main constitution of an EL TV receiver. A tuner 5801 receives a video signal and an audio signal. The video signal is processed by a video signal amplifier circuit 5802, a video signal processing circuit 5803 for converting a signal output from the video signal amplifier circuit 5802 into a color signal corresponding to each color of red, green and blue, and a control circuit 5706 for converting the video signal into the input signal according to specification of a driver circuit. The control circuit 5706 outputs respective signals to the scan line side and the signal line side. In the case of driving in a digital manner, constitution in which the signal dividing circuit 5707 is provided on the signal line side to supply an input digital signal divided into m pieces may be adopted.

The audio signal among the signals received by the tuner 5801 is transmitted to an audio signal amplifier circuit 5804, an output of which is supplied to a speaker 5806 through an audio signal processing circuit 5805. A control circuit 5807 receives control information of a receiving station (reception frequency) or sound volume from an input portion 5808 and transmits signals to the tuner 5801 and the audio signal processing circuit 5805.

By incorporating the EL module into a chassis, a TV receiver can be completed. A display portion is formed with the EL module. In addition, a speaker, a video input terminal, and the like are provided appropriately.

Naturally, the present invention is not limited to the TV receiver, and can be applied to various uses as a large-sized display medium such as an information display board at a train station, an airport, or the like, or an advertisement display board on the street, as well as a monitor of a personal computer.

By using the display device of the invention as described above, it becomes possible to see a high-contrast clear image.

(Embodiment Mode 10)

The present invention can be applied to various electronic devices. Specifically, it can be applied to a display portion of an electronic device. Examples of such an electronic device are as follows: a camera such as a video camera or a digital camera, a goggle type display (a head-mounted display), a navigation system, a sound reproducing device (such as a car audio or an audio component), a computer, a game machine, a portable information terminal (such as a mobile computer, a mobile phone, a portable game machine, or an electronic book), an image reproducing device provided with a recording medium reading portion (specifically, a device which can reproduce a recording medium such as a digital versatile disc (DVD) and includes a light emitting device capable of displaying images thereof), and the like.

Figure 23A:
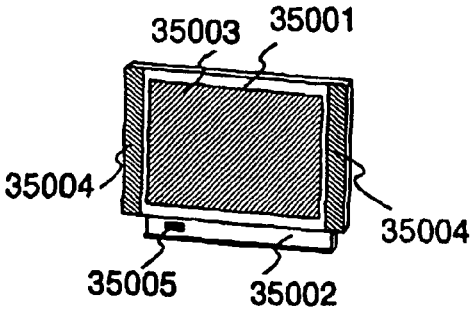
FIGS. 23A to 23H are diagrams explaining electronic devices to which the present invention is applied.

FIG. 23A shows a light emitting device, which includes a chassis 35001, a support 35002, a display portion 35003, a speaker portion 35004, a video input terminal 35005, and the like. The display device of the present invention can be used for the display portion 35003. Note that the light emitting device includes in its category all light emitting devices used for displaying information, for example, for a personal computer, for TV broadcast reception, or for advertisement display. The light emitting device using the present invention for the display portion 35003 makes it possible to see a high-contrast clear image.

Figure 23B:
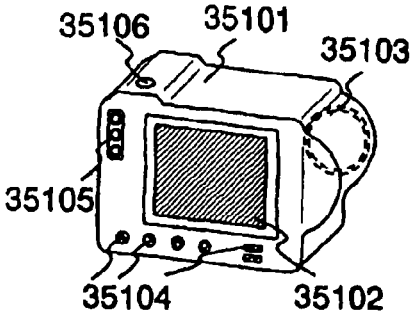

FIG. 23B shows a camera, which includes a main body 35101, a display portion 35102, an image receiving portion 35013, an operation key 35104, an external connection port 35105, a shutter 35106, and the like.

The camera using the present invention for the display portion 35102 makes it possible to see a high-contrast clear image.

Figure 23C:
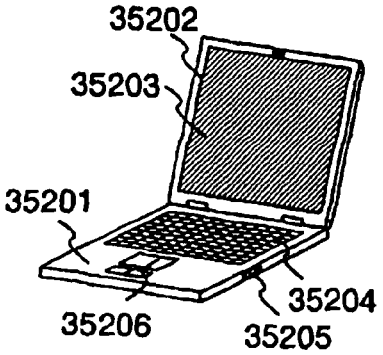

FIG. 23C shows a computer, which includes a main body 35201, a chassis 35202, a display portion 35203, a keyboard 35204, an external connection port 35205, a pointing mouse 35206, and the like. The computer using the present invention for the display portion 35203 makes it possible to see a high-contrast clear image.

Figure 23D:
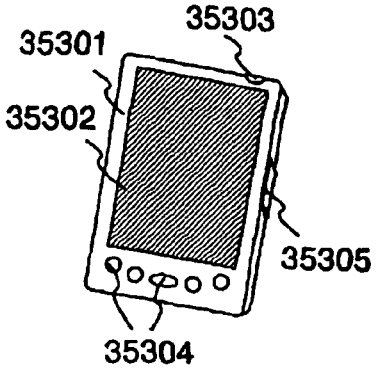

FIG. 23D shows a mobile computer, which includes a main body 35301, a display portion 35302, a switch 35303, an operation key 35304, an infrared port 35305, and the like. The mobile computer using the present invention for the display portion 35302 makes it possible to see a high-contrast clear image.

Figure 23E:
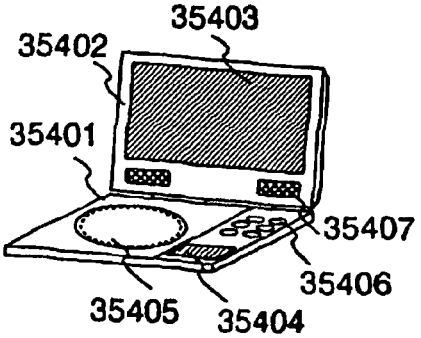

FIG. 23E shows a portable image reproducing device provided with a recording medium reading portion (specifically, a DVD reproducing device), which includes a main body 35401, a chassis 35402, a display portion A 35403, a display portion B 35404, a recording medium (DVD or the like) reading portion 35405, an operation key 35406, a speaker portion 35407, and the like. The display portion A 35403 mainly displays image information, and the display portion B 35404 mainly displays character information. The image reproducing device using the present invention for the display portion A35403 and the display portion B 35404 makes it possible to see a high-contrast clear image.

Figure 23F:
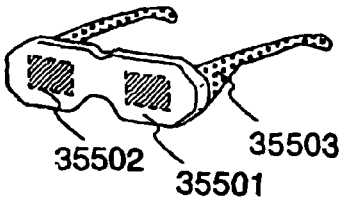

FIG. 23F shows a goggle type display, which includes a main body 35501, a display portion 35502, an arm portion 35503, and the like. The goggle type display using the present invention for the display portion 35502 makes it possible to see a high-contrast clear image.

Figure 23G:
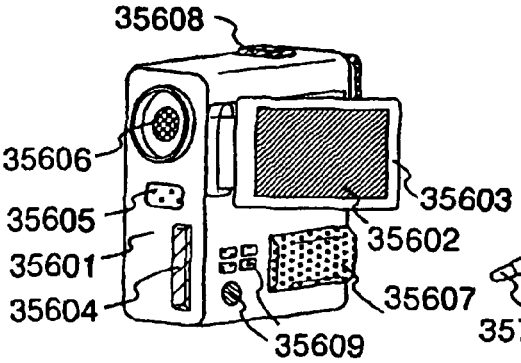

FIG. 23G shows a video camera, which includes a main body 35601, a display portion 35602, a chassis 35603, an external connection port 35604, a remote control receiving portion 35605, an image receiving portion 35606, a battery 35607, an audio input portion 35608, an operation key 35609, and the like. The video camera using the present invention for the display portion 35602 makes it possible to see a high-contrast clear image.

Figure 23H:
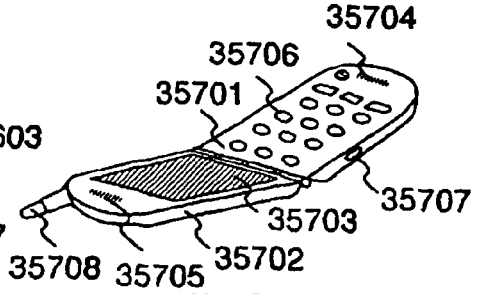

FIG. 23H shows a mobile phone, which includes a main body 35701, a chassis 35702, a display portion 35703, an audio input portion 35704, an audio output portion 35705, an operation key 35706, an external connection port 35707, an antenna 35708, and the like. The mobile phone using the present invention for the display portion 35703 makes it possible to see a high-contrast clear image.

As described above, the applicable range of the present invention is so wide that the invention can be applied to electronic devices of various fields. In addition, the electronic device of this embodiment mode may use a display device having any of the structures described in Embodiment Modes 1 to 9.

This application is based on Japanese Patent Application serial no. 2005-133825 filed in Japan Patent Office on May 2, 2005, the contents of which are hereby incorporated by reference.

What is claimed is:

1. A display device comprising:

a display region comprising a first region including a first pixel array, a second region including a second pixel array and a third region including a third pixel array, wherein the first region, the second region and the third region are configured to perform a display at the same time, wherein the first region excludes the second region and the third region and is smaller than the second region, wherein the third region excludes the second region and is smaller than the second region, and wherein the second region is between the first region and the third region;

a source driver and a gate driver each electrically connected to the first region, the second region and the third region, and a circuit from which an analog signal and a digital signal supplied to the source driver are output, wherein the source driver is configured to drive the first pixel array exclusive of the second pixel array and the third pixel array in a digital display mode using a video signal consisting of a binary value, wherein the source driver is configured to drive the second pixel array exclusive of the first pixel array and the third pixel array in an analog display mode using a video signal consisting of the analog signal, wherein the source driver is configured to drive the third pixel array exclusive of the first pixel array and the second pixel array in a multi-valued display mode using a video signal consisting of a multi-valued digital signal which is different from the video signal consisting of the binary value and the video signal consisting of the analog signal, wherein the driving of the first pixel array in the digital display mode, the driving of the second pixel array in the analog display mode, and the driving of the third pixel array in the multi-valued display mode by the source driver occurs at the same time to perform the display, wherein the first pixel array of the first region comprises first pixels, each including a first TFT and a first display element, wherein the second pixel array of the second region comprises second pixels, each including a second TFT, a capacitor element, and a second display element, and wherein the capacitor element comprises a semiconductor layer, an insulating layer, and a conductive layer.

2. The display device according to claim 1, wherein the circuit includes a binarization circuit, and wherein the analog signal is input to the circuit, and the analog signal is converted into the digital signal using the binarization circuit.

3. The display device according to claim 1, wherein the circuit includes a DA converter circuit, and wherein the digital signal is input to the circuit, and the digital signal is converted into the analog signal using the DA converter circuit.

4. The display device according to claim 1, wherein each of the first display element and the second display element is a light emitting element.

5. The display device according to claim 1, wherein the first region is a peripheral region of the display region and the second region is a center region of the display region.

6. The display device according to claim 1, wherein the driving of the first pixel array exclusive of the second pixel array in the digital display mode includes a digital gray scale method, and the driving of the second pixel array exclusive of the first pixel array in the analog display mode includes an analog gray scale method.

7. A display device comprising:

a display region comprising a first region including a first pixel array, a second region including a second pixel array and a third region including a third pixel array, wherein the first region, the second region and the third region are configured to perform a display at the same time, wherein the first region excludes the second region and the third region and is smaller than the second region, wherein the third region excludes the second region and is smaller than the second region, and wherein the second region is between the first region and the third region; and a source driver and a gate driver each electrically connected to the first region and the second region, wherein the source driver is configured to drive the first pixel array exclusive of the second pixel array and the third pixel array in a digital display mode using a video signal consisting of a binary value, wherein the source driver is configured to drive the second pixel array exclusive of the first pixel array and the third pixel array in an analog display mode using a video signal consisting of an analog signal, wherein the source driver is configured to drive the third pixel array exclusive of the first pixel array and the second pixel array in a multi-valued display mode using a video signal consisting of a multi-valued digital signal which is different from the video signal consisting of the binary value and the video signal consisting of the analog signal, wherein the driving of the first pixel array in the digital display mode, the driving of the second pixel array in the analog display mode, and the driving of the third pixel array in the multi-valued display mode by the source driver occurs at the same time to perform the display, wherein the first pixel array displays characters, wherein the second pixel array displays images, wherein the first pixel array of the first region comprises first pixels, each including a first TFT and a first display element, wherein the second pixel array of the second region comprises second pixels, each including a second TFT, a capacitor element, and a second display element, and wherein the capacitor element comprises a semiconductor layer, an insulating layer and a conductive layer.

8. The display device according to claim 7, wherein each of the first display element and the second display element is a light emitting element.

9. The display device according to claim 7, wherein the first region is a peripheral region of the display region and the second region is a center region of the display region.

10. The display device according to claim 7, wherein the driving of the first pixel array exclusive of the second pixel array in the digital display mode includes a digital gray scale method, and the driving of the second pixel array exclusive of the first pixel array in the analog display mode includes an analog gray scale method.

11. A display device comprising:

a display region comprising a first region including a first pixel array, a second region including a second pixel array and a third region including a third pixel array, wherein the first region, the second region and the third region are configured to perform a display at the same time, wherein the first region excludes the second region and the third region and is located along one side of the display region, wherein the third region excludes the second region and is smaller than the second region, and wherein the second region is between the first region and the third region;

a source driver and a gate driver each electrically connected to the first region, the second region and the third region, and a circuit from which an analog signal and a digital signal supplied to the source driver are output, wherein the source driver is configured to drive the first pixel array exclusive of the second pixel array and the third pixel array in a digital display mode using a video signal consisting of a binary value, wherein the source driver is configured to drive the second pixel array exclusive of the first pixel array and the third pixel array in an analog display mode using a video signal consisting of the analog signal, wherein the source driver is configured to drive the third pixel array exclusive of the first pixel array and the second pixel array in a multi-valued display mode using a video signal consisting of a multi-valued digital signal which is different from the video signal consisting of the binary value and the video signal consisting of the analog signal, wherein the driving of the first pixel array in the digital display mode, the driving of the second pixel array in the analog display mode, and the driving of the third pixel array in the multi-valued display mode by the source driver occurs at the same time to perform the display, wherein the first pixel array of the first region comprises first pixels, each including a first TFT and a first display element, wherein the second pixel array of the second region comprises second pixels, each including a second TFT, a capacitor element, and a second display element, and wherein the capacitor element comprises a semiconductor layer, an insulating layer, and a conductive layer.

12. The display device according to claim 11, wherein the circuit includes a binarization circuit, and wherein the analog signal is input to the circuit, and the analog signal is converted into the digital signal using the binarization circuit.

13. The display device according to claim 11, wherein the circuit includes a DA converter circuit, and wherein the digital signal is input to the circuit, and the digital signal is converted into the analog signal using the DA converter circuit.

14. The display device according to claim 11, wherein each of the first display element and the second display element is a light emitting element.

15. The display device according to claim 11, wherein the driving of the first pixel array exclusive of the second pixel array in the digital display mode includes a digital gray scale method, and the driving of the second pixel array exclusive of the first pixel array in the analog display mode includes an analog gray scale method.

* * * * *